US009626894B2

(12) United States Patent
Gu

(10) Patent No.: US 9,626,894 B2
(45) Date of Patent: Apr. 18, 2017

(54) METHOD AND APPARATUS FOR SUBPIXEL RENDERING

(71) Applicant: SHENZHEN YUNYINGGU TECHNOLOGY CO., LTD, Shenzhen (CN)

(72) Inventor: Jing Gu, Shanghai (CN)

(73) Assignee: SHENZHEN YUNYINGGU TECHNOLOGY CO., LTD. (CN)

( * ) Notice: Subject to any disclaimer, the term of this patent is extended or adjusted under 35 U.S.C. 154(b) by 0 days.

(21) Appl. No.: 14/817,613

(22) Filed: Aug. 4, 2015

(65) Prior Publication Data

US 2015/0339969 A1 Nov. 26, 2015

Related U.S. Application Data

(63) Continuation of application No. PCT/CN2013/083355, filed on Sep. 12, 2013.

(51) Int. Cl.
*G09G 3/30* (2006.01)
*G09G 3/20* (2006.01)
(Continued)

(52) U.S. Cl.
CPC ..... *G09G 3/2074* (2013.01); *G09G 3/2003* (2013.01); *G09G 3/3208* (2013.01);
(Continued)

(58) Field of Classification Search
CPC ... G09G 2300/0452; G09G 2300/0804; G09G 2300/0814; G09G 2300/0842;
(Continued)

(56) References Cited

U.S. PATENT DOCUMENTS

2002/0070909 A1* 6/2002 Asano ..... G09G 3/3233 345/76
2005/0083352 A1* 4/2005 Higgins ..... G09G 3/2003 345/690
(Continued)

FOREIGN PATENT DOCUMENTS

CN 1662071 A 8/2005
CN 101442683 A 5/2009
(Continued)

OTHER PUBLICATIONS

International Search Report issued Jun. 12, 2014 in International Application No. PCT/CN2013/083355.
(Continued)

*Primary Examiner* — Kwin Xie
(74) *Attorney, Agent, or Firm* — Sterne, Kessler, Goldstein and Fox P.L.L.C.

(57) ABSTRACT

Method and apparatus for subpixel rendering. In one example, for each of an array of pixels on a display, a first signal including a first set of components is received. The first set of components are converted to a second set of components. The second set of components include a first component representing a first attribute of the pixel and a second component representing a second attribute of the pixel. The second set of components of the first signal are modified to generate a second signal by applying at least one operation to at least one of the first and second components based on the corresponding attribute of the pixel. The modified second set of components are converted to a modified first set of components of the second signal. A third signal is generated based on the modified first set of components for rendering subpixels corresponding to the pixel.

22 Claims, 16 Drawing Sheets

(51) Int. Cl.
*G09G 3/3208* (2016.01)
*G09G 5/02* (2006.01)

(52) U.S. Cl.
CPC ..... *G09G 5/02* (2013.01); *G09G 2300/0452* (2013.01); *G09G 2320/0242* (2013.01); *G09G 2320/0666* (2013.01); *G09G 2340/0457* (2013.01); *G09G 2340/06* (2013.01)

(58) Field of Classification Search
CPC ..... G09G 3/3233; H01L 27/3211; H01L 27/3248; H01L 27/326
USPC ..... 345/76–84
See application file for complete search history.

(56) References Cited

U.S. PATENT DOCUMENTS

2005/0185836 A1 8/2005 Huang
2006/0076550 A1 4/2006 Kwak et al.
2007/0058113 A1 3/2007 Wu et al.
2007/0176950 A1* 8/2007 Brown Elliott ... G02F 1/133514 345/694
2009/0141488 A1* 6/2009 Silverstein ..... G09G 3/003 362/231
2012/0148209 A1 6/2012 Gunji
2013/0027437 A1 1/2013 Gu
2016/0027359 A1* 1/2016 Guo ..... G09G 3/2003 345/694

FOREIGN PATENT DOCUMENTS

CN WO 2015149476 A1 * 10/2015 ..... G02F 1/1362
WO 2013130186 A1 9/2013

OTHER PUBLICATIONS

European Search Report directed to European Patent Application No. 13893424.5, dated Jan. 16, 2017.

* cited by examiner

1300

METHOD AND APPARATUS FOR SUBPIXEL RENDERING

CROSS REFERENCE TO RELATED APPLICATION

This application is continuation of International Application No. PCT/CN2013/083355, filed on Sep. 12, 2013, entitled "METHOD AND APPARATUS FOR SUBPIXEL RENDERING," which is hereby incorporated by reference in its entirety.

BACKGROUND

The disclosure relates generally to display technology, and more particularly, to method and apparatus for subpixel rendering.

Displays are commonly characterized by display resolution, which is the number of distinct pixels in each dimension that can be displayed (e.g., 1920×1080). Many displays are, for various reasons, not capable of displaying different color channels at the same site. Therefore, the pixel grid is divided into single-color parts that contribute to the displayed color when viewed at a distance. In some displays, such as liquid crystal display (LCD), organic light emitting diode (OLED) display, electrophoretic ink (E-ink) display, or electroluminescent display (ELD), these single-color parts are separately addressable elements, which are known as subpixels.

Various subpixel arrangements (layouts, schemes) have been proposed to operate with a proprietary set of subpixel rendering algorithms in order to improve the display quality by increasing the apparent resolution of a display and by anti-aliasing text with greater details. For example, LCDs typically divide each pixel into three strip subpixels (e.g., red, green, and blue subpixels) or four quadrate subpixels (e.g., red, green, blue, and white subpixels). For OLED displays, due to the limitation of fabrication process, subpixels cannot be arranged too close to each other.

Color rendering approach has been applied to reduce the number of subpixels in each pixel without lowering the display resolution. PenTile® technology is one of the examples that implement the color rendering approach. In designing subpixel arrangements for displays, it is desired that different colors of subpixels, e.g., red, green, and blue subpixels, are uniformly distributed, i.e., the numbers of each color of subpixels are the same, and the distances between different colors of subpixels are substantially the same. However, for subpixel arrangements using PenTile® technology, the number of green subpixels is twice of the number of red or blue subpixel, i.e., the resolution of red or blue color is half of the resolution of green color. The distance between two adjacent subpixels with different colors (relative distance) also varies for subpixel arrangements using PenTile® technology.

It is also commonly known that each pixel on a display can be associated with various attributes, such as luminance (brightness, a.k.a. luma,) and chrominance (color, a.k.a. chroma) in the YUV color model. Most of the known solutions for subpixel rendering use native display data generated based on the RGB color model, which consists of three primary color components, red (R), green (G), and blue (B). However, since the human vision system is not as sensitive to color as to brightness, the known solutions of using three or four subpixels to constitute a full-color pixel and rendering the subpixels using native RGB display data may cause the waste of display bandwidth and thus, are not always desirable.

Accordingly, there exists a need for improved method and apparatus for subpixel rendering to overcome the above-mentioned problems.

SUMMARY

The disclosure relates generally to display technology, and more particularly, to method and apparatus for subpixel rendering.

In one example, a method for subpixel rendering is provided. For each of an array of pixels on a display, a first signal including a first set of components is received. The first set of components of the first signal are then converted to a second set of components of the first signal. The second set of components of the first signal include a first component representing a first attribute of the pixel and a second component representing a second attribute of the pixel. The second set of components of the first signal are then modified to generate a second signal including a modified second set of components by applying at least one operation to at least one of the first and second components based on the corresponding attribute of the pixel. The modified second set of components of the second signal are then converted to a modified first set of components of the second signal. A third signal is generated based on the modified first set of components of the second signal for rendering subpixels corresponding to the pixel.

In a different example, a device for subpixel rendering includes a first signal converting unit, a signal processing module, a second signal converting unit, and a subpixel rendering module. The first signal converting unit is configured to, for each of an array of pixels on a display, receive a first signal including a first set of components. The first signal converting unit is further configured to convert the first set of components of the first signal to a second set of components of the first signal. The second set of components of the first signal include a first component representing a first attribute of the pixel and a second component representing a second attribute of the pixel. The signal processing module is configured to, for each pixel, modify the second set of components of the first signal to generate a second signal including a modified second set of components by applying at least one operation to at least one of the first and second components based on the corresponding attribute of the pixel. The second signal converting unit is configured to, for each pixel, convert the modified second set of components of the second signal to a modified first set of components of the second signal. The subpixel rendering module is configured to generate a third signal based on the modified first set of components of the second signal for rendering subpixels corresponding to the pixel.

In another different example, an apparatus includes a display and control logic. The display has an array of subpixels arranged in a repeating pattern thereon. Two adjacent subpixels in the same row of subpixels correspond to a pixel on the display. A first subpixel repeating group and a second subpixel repeating group are alternatively applied to two adjacent rows of subpixels. Two adjacent rows of subpixels are staggered with each other. The control logic is operatively connected to the display and configured to render the array of subpixels. The control logic includes a first signal converting unit, a signal processing module, a second signal converting unit, and a subpixel rendering module. The first signal converting unit is configured to, for each of an array of pixels on a display, receive a first signal including a first set of components. The first signal converting unit is further configured to convert the first set of components of the first signal to a second set of components of the first signal. The second set of components of the first signal include a first component representing a first attribute of the pixel and a second component representing a second attribute of the pixel. The signal processing module is configured to, for each pixel, modify the second set of components of the first signal to generate a second signal including a modified second set of components by applying at least one operation to at least one of the first and second components based on the corresponding attribute of the pixel. The second signal converting unit is configured to, for each pixel, convert the modified second set of components of the second signal to a modified first set of components of the second signal. The subpixel rendering module is configured to generate a third signal based on the modified first set of components of the second signal for rendering the two subpixels corresponding to the pixel.

Other concepts relate to software for implementing the method for subpixel rendering. A software product, in accord with this concept, includes at least one machine-readable non-transitory medium and information carried by the medium. The information carried by the medium may be executable program code data regarding parameters in association with a request or operational parameters, such as information related to a user, a request, or a social group, etc.

In one example, a machine readable and non-transitory medium having information recorded thereon for subpixel rendering, where when the information is read by the machine, causes the machine to perform a series of steps. For each of an array of pixels on a display, a first signal including a first set of components is received. The first set of components of the first signal are then converted to a second set of components of the first signal. The second set of components of the first signal include a first component representing a first attribute of the pixel and a second component representing a second attribute of the pixel. The second set of components of the first signal are then modified to generate a second signal including a modified second set of components by applying at least one operation to at least one of the first and second components based on the corresponding attribute of the pixel. The modified second set of components of the second signal are then converted to a modified first set of components of the second signal. A third signal is generated based on the modified first set of components of the second signal for rendering subpixels corresponding to the pixel.

BRIEF DESCRIPTION OF THE DRAWINGS

The embodiments will be more readily understood in view of the following description when accompanied by the below figures and wherein like reference numerals represent like elements, wherein.

DETAILED DESCRIPTION

In the following detailed description, numerous specific details are set forth by way of examples in order to provide a thorough understanding of the relevant disclosures. However, it should be apparent to those skilled in the art that the present disclosure may be practiced without such details. In other instances, well known methods, procedures, systems, components, and/or circuitry have been described at a relatively high-level, without detail, in order to avoid unnecessarily obscuring aspects of the present disclosure.

Among other novel features, the present disclosure provides the ability to reduce display bandwidth while maintaining the same or similar apparent display resolution. It is understood that different components in the display data are not equally important for apparent display resolution as the human vision system has different levels of sensitivities with respect to different attributes represented by each component in the display data. For example, compared to luminance component, chrominance component is less important for apparent display resolution, and the changes of chrominance component among adjacent pixels are more gradual (lower bandwidth). As a result, components that are less important for apparent display resolution, such as chrominance component, can be reduced in the display data to save display bandwidth. Such ability promotes subpixel rendering on a display. The novel subpixel rendering method and subpixel arrangements in the present disclosure do not compromise the apparent color resolution and uniformity of color distribution on the display. In one example of the present disclosure, as each pixel is divided equally into two subpixels instead of the conventional three strip subpixels or four quadrate subpixels, the number of addressable display elements per unit area of a display can be increased without changing the current manufacturing process.

Additional novel features will be set forth in part in the description which follows, and in part will become apparent to those skilled in the art upon examination of the following and the accompanying drawings or may be learned by production or operation of the examples. The advantages of the present teachings may be realized and attained by practice or use of various aspects of the methodologies, instrumentalities, and combinations set forth in the detailed examples discussed below.

Figure 1:
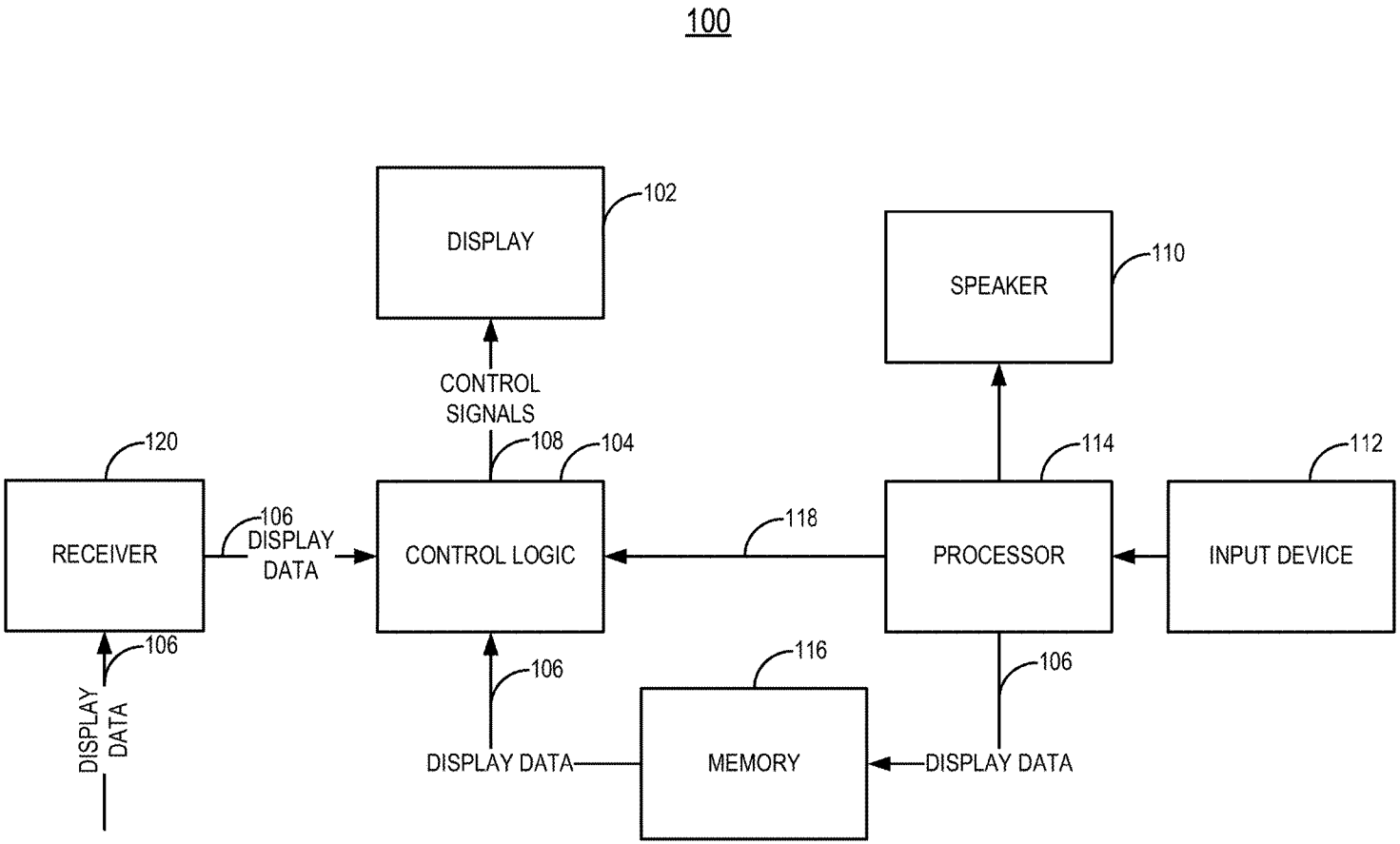
FIG. 1 is a block diagram illustrating an apparatus including a display and control logic.

FIG. 1 illustrates an apparatus 100 including a display 102 and control logic 104. The apparatus 100 may be any suitable device, for example, a television set, laptop computer, desktop computer, netbook computer, media center, handheld device (e.g., dumb or smart phone, tablet, etc.), electronic billboard, gaming console, set-top box, printer, or any other suitable device. In this example, the display 102 is operatively coupled to the control logic 104 and is part of the apparatus 100, such as but not limited to, a television screen, computer monitor, dashboard, head-mounted display, or electronic billboard. The display 102 may be an LCD, OLED display, E-ink display, ELD, billboard display with incandescent lamps, or any other suitable type of display. The control logic 104 may be any suitable hardware, software, firmware, or combination thereof, configured to receive display data 106 and render the received display data 106 into control signals 108 for driving an array of subpixels on the display 102. For example, subpixel rendering algorithms for various subpixel arrangements may be part of the control logic 104 or implemented by the control logic 104. The control logic 104 may include any other suitable components, including for example an encoder, a decoder, one or more processors, controllers (e.g., timing controller), and storage devices. The control logic 104 may be implemented as a standalone integrated circuit (IC) chip or part of the driving circuits of the display 102. The apparatus 100 may also include any other suitable component such as, but not limited to, a speaker 110 and an input device 112, e.g., a mouse, keyboard, remote controller, handwriting device, camera, microphone, scanner, etc.

In one example, the apparatus 100 may be a laptop or desktop computer having a display 102. In this example, the apparatus 100 also includes a processor 114 and memory 116. The processor 114 may be, for example, a graphic processor (e.g., GPU), a general processor (e.g., APU, accelerated processing unit; GPGPU, general-purpose computing on GPU), or any other suitable processor. The memory 116 may be, for example, a discrete frame buffer or a unified memory. The processor 114 is configured to generate display data 106 in display frames and temporally store the display data 106 in the memory 116 before sending it to the control logic 104. The processor 114 may also generate other data, such as but not limited to, control instructions 118 or test signals, and provide them to the control logic 104 directly or through the memory 116. The control logic 104 then receives the display data 106 from the memory 116 or from the processor 114 directly. In other examples, at least part of the control logic 104 may be implemented as software that is stored in the memory 116 and executed by the processor 114.

In another example, the apparatus 100 may be a television set having a display 102. In this example, the apparatus 100 also includes a receiver 120, such as but not limited to, an antenna, radio frequency receiver, digital signal tuner, digital display connectors, e.g., HDMI, DVI, DisplayPort, USB, Bluetooth, WiFi receiver, or Ethernet port. The receiver 120 is configured to receive the display data 106 as an input of the apparatus 100 and provide the display data 106 to the control logic 104.

In still another example, the apparatus 100 may be a handheld device, such as a smart phone or a tablet. In this example, the apparatus 100 includes the processor 114, memory 116, and the receiver 120. The apparatus 100 may both generate display data 106 by its processor 114 and receive display data 106 through its receiver 120. For example, the apparatus 100 may be a handheld device that works as both a portable television and a portable computing device. In any event, the apparatus 100 at least includes the display 102 and control logic 104 for rendering the array of subpixels on the display 102.

Figure 17:
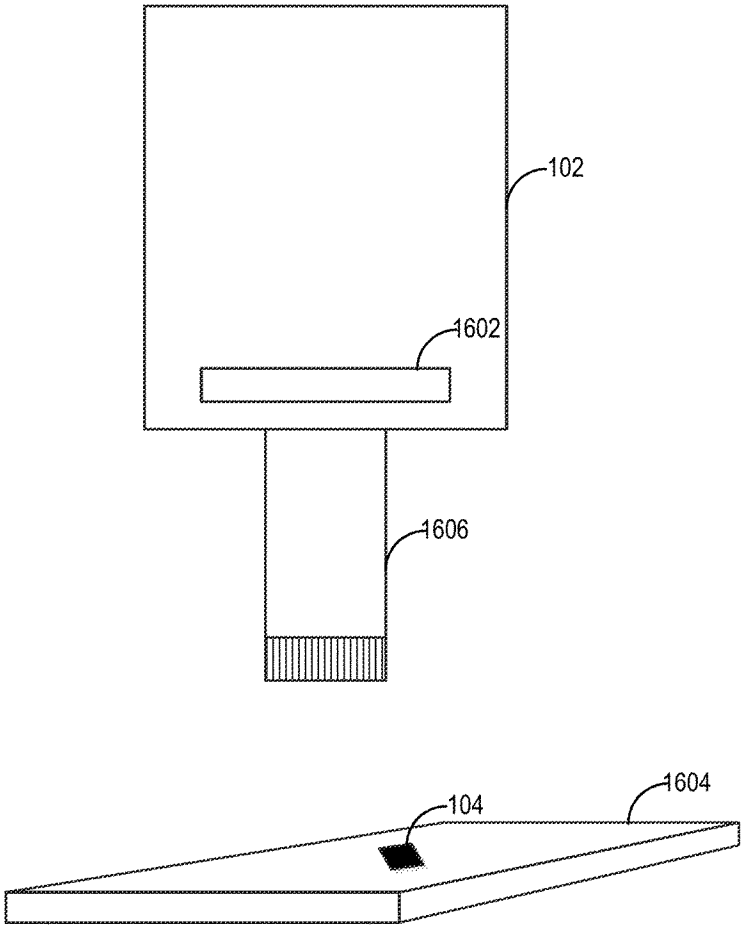
FIG. 17 is a diagram illustrating another example of implementing the control logic as an IC chip in accordance with one embodiment set forth in the disclosure.
Figure 16:
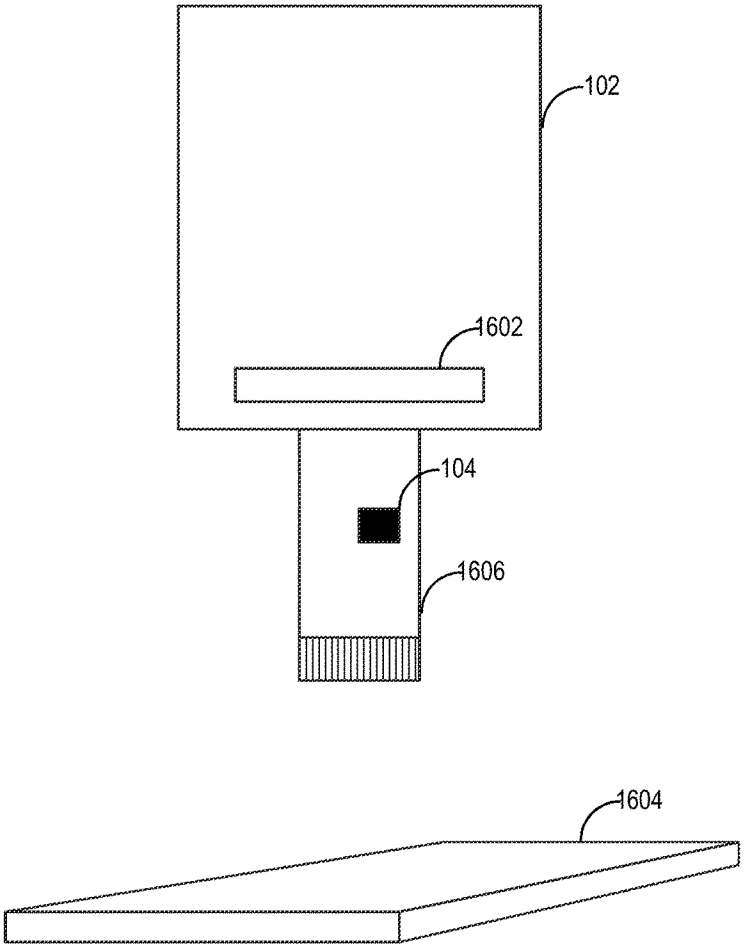
FIG. 16 is a diagram illustrating one example of implementing the control logic as an integrated circuit (IC) chip in accordance with one embodiment set forth in the disclosure.

Referring now to FIGS. 16 and 17, the control logic 104 is implemented as a standalone IC chip in these examples, such as a field-programmable gate array (FPGA) or an application-specific integrated circuit (ASIC). In one example illustrated in FIG. 16, the apparatus 100 is a handheld device such as a smartphone or a tablet, which includes the display 102 with driving circuits 1602 and a motherboard 1604. The display 102 is connected to the motherboard 1604 through a flexible printed circuit (FPC) 1606. The IC chip implementing the control logic 104 is arranged on the FPC 1606 such that the handheld device can be easily integrated with the control logic 104 without changing the motherboard 1604. In another example illustrated in FIG. 17, the IC chip implementing the control logic 104 is arranged on the motherboard 1604 to reduce the cost of the handheld device.

Figure 2:
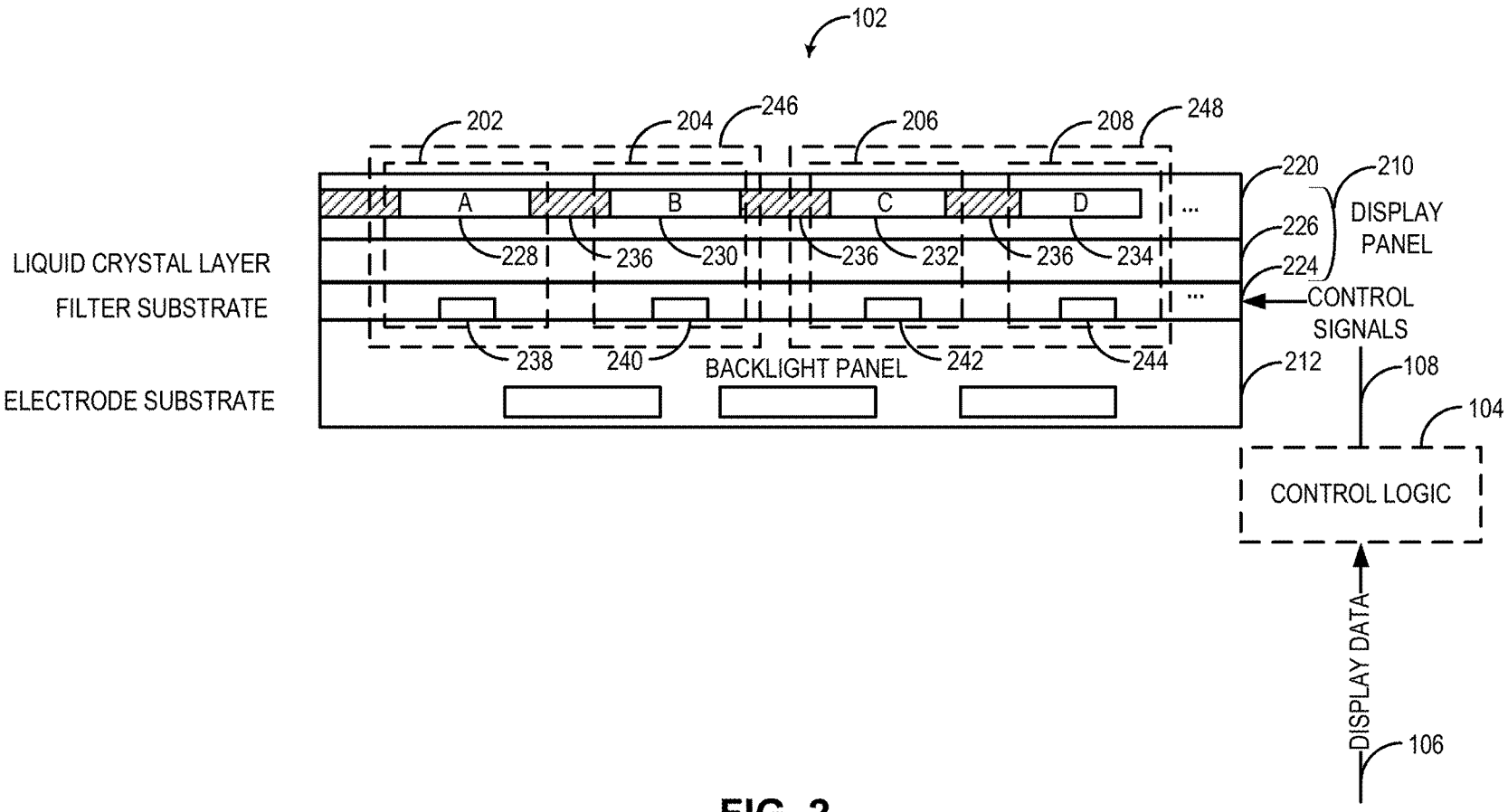
FIG. 2 is a diagram illustrating one example of the display of the apparatus shown in FIG. 1 in accordance with one embodiment set forth in the disclosure.

FIG. 2 illustrates one example of the display 102 including an array of subpixels 202, 204, 206, 208. The display 102 may be any suitable type of display, for example, LCDs, such as a twisted nematic (TN) LCD, in-plane switching (IPS) LCD, advanced fringe field switching (AFFS) LCD, vertical alignment (VA) LCD, advanced super view (ASV) LCD, blue phase mode LCD, passive-matrix (PM) LCD, or any other suitable display. The display 102 includes a display panel 210 and a backlight panel 212, which are operatively coupled to the control logic 104. The backlight panel 212 includes light sources for providing lights to the display panel 210, such as but not limited to, incandescent light bulbs, LEDs, EL panel, cold cathode fluorescent lamps (CCFLs), and hot cathode fluorescent lamps (HCFLs), to name a few.

The display panel 210 may be, for example, a TN panel, an IPS panel, an AFFS panel, a VA panel, an ASV panel, or any other suitable display panel. In this example, the display panel 210 includes a filter substrate 220, an electrode substrate 224, and a liquid crystal layer 226 disposed between the filter substrate 220 and the electrode substrate 224. As shown in FIG. 2, the filter substrate 220 includes a plurality of filters 228, 230, 232, 234 corresponding to the plurality of subpixels 202, 204, 206, 208, respectively. A, B, C, and D in FIG. 2 denote four different types of filters, such as but not limited to, red, green, blue, yellow, cyan, magenta, or white filter. The filter substrate 220 also includes a black matrix 236 disposed between the filters 228, 230, 232, 234 as shown in FIG. 2. The black matrix 236, as the borders of the subpixels 202, 204, 206, 208, is used for blocking lights coming out from the parts outside the filters 228, 230, 232, 234. In this example, the electrode substrate 224 includes a plurality of electrodes 238, 240, 242, 244 with switching elements, such as thin film transistors (TFTs), corresponding to the plurality of filters 228, 230, 232, 234 of the plurality of subpixels 202, 204, 206, 208, respectively. The electrodes 238, 240, 242, 244 with the switching elements are individually addressed by the control signals 108 from the control logic 104 and are configured to drive the corresponding subpixels 202, 204, 206, 208 by controlling the light passing through the respective filters 228, 230, 232, 234 according to the control signals 108. The display panel 210 may include any other suitable component, such as one or more glass substrates, polarization layers, or a touch panel, as known in the art.

As shown in FIG. 2, each of the plurality of subpixels 202, 204, 206, 208 is constituted by at least a filter, a corresponding electrode, and the liquid crystal region between the corresponding filter and electrode. The filters 228, 230, 232, 234 may be formed of a resin film in which dyes or pigments having the desired color are contained. Depending on the characteristics (e.g., color, thickness, etc.) of the respective filter, a subpixel may present a distinct color and brightness. In this example, two adjacent subpixels correspond to one pixel for display. For example, subpixels A 202 and B 204 correspond to a pixel 246, and subpixels C 206 and D 208 correspond to another pixel 248. Here, since the display data 106 is usually programmed at the pixel level, the two subpixels of each pixel or the multiple subpixels of several adjacent pixels may be addressed collectively by subpixel rendering to present the brightness and color of each pixel, as designated in the display data 106, with the help of subpixel rendering method described below in detail.

Figure 3:
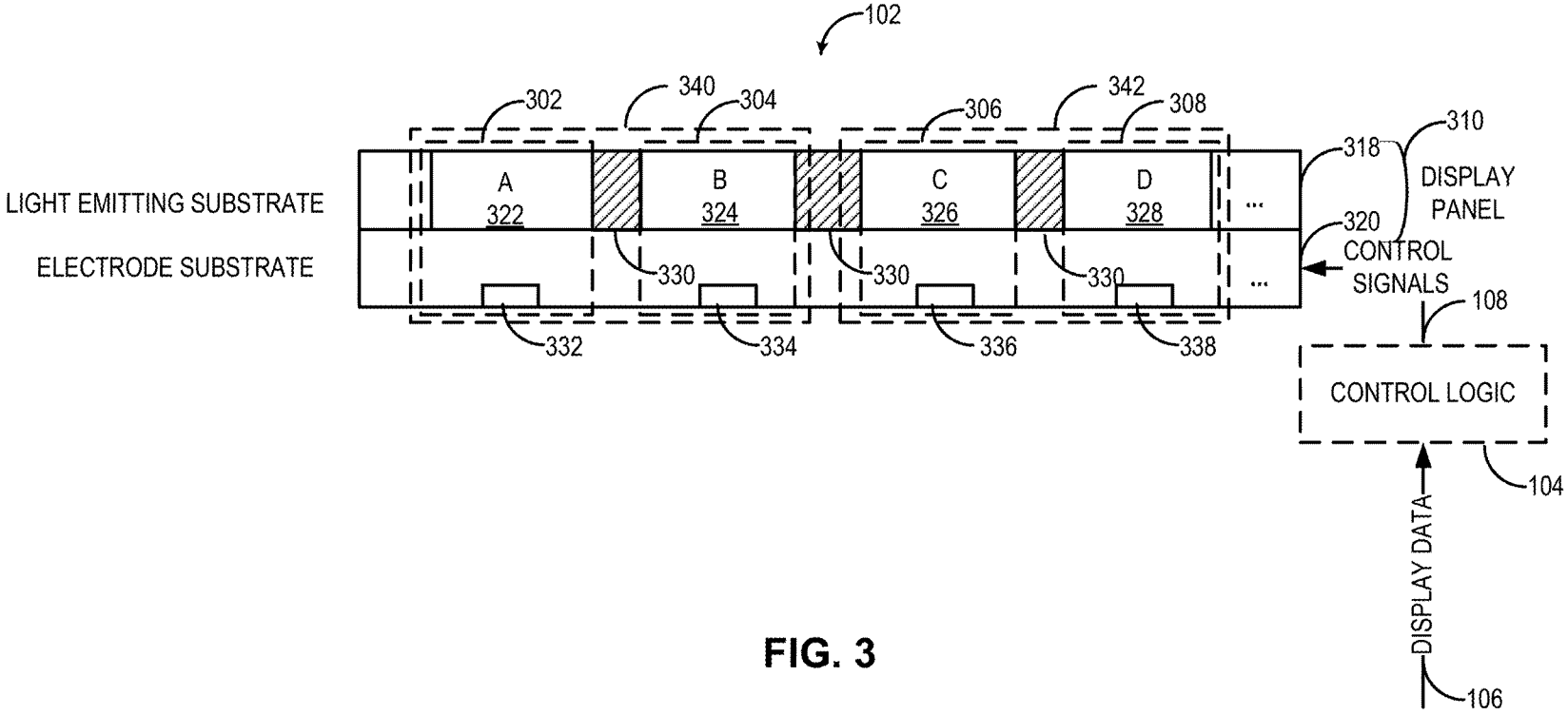
FIG. 3 is a diagram illustrating another example of the display of the apparatus shown in FIG. 1 in accordance with one embodiment set forth in the disclosure.

FIG. 3 illustrates another example of a display 102 including an array of subpixels 302, 304, 306, 308. The display 102 may be any suitable type of display, for example, OLED displays, such as an active-matrix (AM) OLED display, passive-matrix (PM) OLED display, or any other suitable display. The display 102 includes a display panel 310 operatively coupled to the control logic 104. Different from FIG. 2, a backlight panel is not necessary for an OLED display 102 in FIG. 3 as the display panel 310 can emit lights by the OLEDs therein.

In this example, the display panel 310 includes a light emitting substrate 318 and an electrode substrate 320. As shown in FIG. 3, the light emitting substrate 318 includes a plurality of OLEDs 322, 324, 326, 328 corresponding to the plurality of subpixels 302, 304, 306, 308, respectively. A, B, C, and D in FIG. 3 denote four different types of OLEDs, such as but not limited to, red, green, blue, yellow, cyan, magenta, or white OLED. The light emitting substrate 318 also includes a black matrix 330 disposed between the OLEDs 322, 324, 326, 328, as shown in FIG. 3. The black matrix 330, as the borders of the subpixels 302, 304, 306, 308, is used for blocking lights coming out from the parts outside the OLEDs 322, 324, 326, 328. Different from FIG. 2, a filter substrate is not necessary for an OLED display 102 as each OLED in the light emitting substrate 318 can emit light with a predetermined color and brightness. In this example, the electrode substrate 320 includes a plurality of electrodes 332, 334, 336, 338 with switching elements, such as TFTs, corresponding to the plurality of OLEDs 322, 324, 326, 328 of the plurality of subpixels 302, 304, 306, 308, respectively. The electrodes 332, 334, 336, 338 with the switching elements are individually addressed by the control signals 108 from the control logic 104 and are configured to drive the corresponding subpixels 302, 304, 306, 308 by controlling the light emitting from the respective OLEDs 322, 324, 326, 328 according to the control signals 108. The display panel 310 may include any other suitable component, such as one or more glass substrates, polarization layers, or a touch panel, as known in the art.

As shown in FIG. 3, each of the plurality of subpixels 302, 304, 306, 308 is constituted by at least an OLED and a corresponding electrode. Each OLED is formed by a sandwich structure of anode, light emitting layers, and cathode, as known in the art. Depending on the characteristics (e.g., material, structure, etc.) of the light emitting layers of the respective OLED, a subpixel presents a distinct color and brightness. In this example, two adjacent subpixels correspond to one pixel for display. For example, subpixels A 302 and B 304 correspond to a pixel 340, and subpixels C 306 and D 308 correspond to another pixel 342. Here, since the display data 106 is usually programmed at the pixel level, the two subpixels of each pixel or the multiple subpixels of several adjacent pixels may be addressed collectively by subpixel rendering to present the appropriate brightness and color of each pixel, as designated in the display data 106, with the help of subpixel rendering method described below in detail.

Although FIGS. 2 and 3 are illustrated as an LCD display and an OLED display, respectively, it is understood that FIGS. 2 and 3 are provided for an exemplary purpose only and without limitations. As noted above, in addition to LCD and OLED display, the display 102 may be an E-ink display, an ELD, a billboard display with incandescent lamps, or any other suitable type of display.

Figure 4:
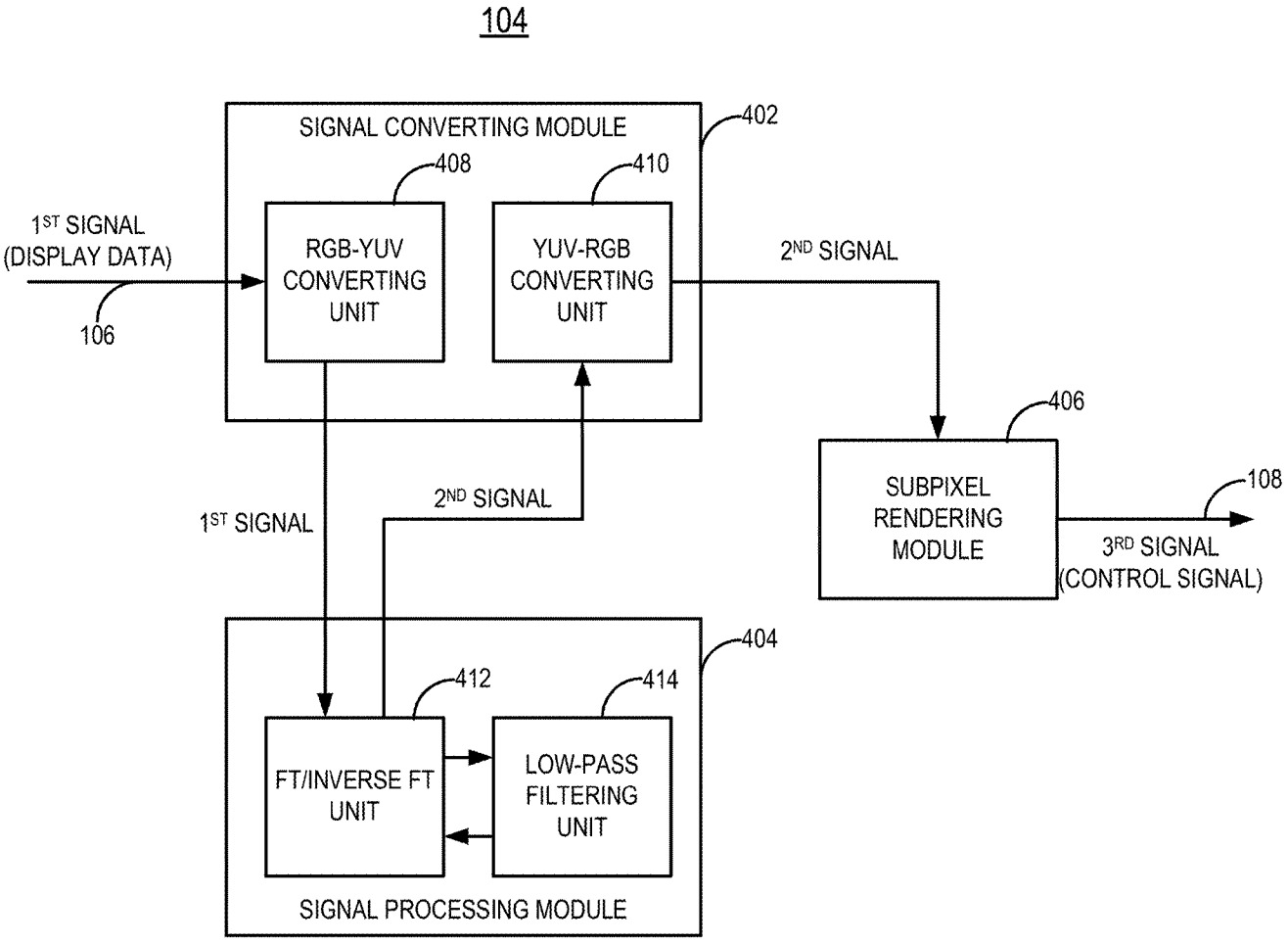
FIG. 4 is a block diagram illustrating one example of the control logic of the apparatus shown in FIG. 1 in accordance with one embodiment set forth in the disclosure.

FIG. 4 illustrates an example of the control logic 104 of the apparatus 100 shown in FIG. 1 in accordance with one embodiment set forth in the disclosure. The control logic 104 in this example is configured to generate signals with lower display bandwidth for subpixel rendering by taking human perception into account, allowing reduced bandwidth for certain components in the native display data that are less important for apparent display resolution. The control logic 104 includes a signal converting module 402, a signal processing module 404, and a subpixel rendering module 406, each of which may be implemented as hardware, software, firmware, or combination thereof. For example, one or more modules 402, 404, 406 may be implemented as software executed by a processor or as an IC, such as a FPGA or ASIC.

The signal converting module 402 may include one or more units for converting display signals between different types. It is known that the display data 106 may be represented using various color models, including but not limited to RGB (red, green, blue) color model, YUV (luminance, chrominance) color mode, HSL (hue, saturation, luminance) color model, HSB (hue, saturation, brightness) color model, etc. The display data 106 includes a set of components based on the particular color model. For example, display data represented using RGB model includes R, G, and B, three primary color components; display data represented using YUV color models includes one luminance component Y and two chrominance components U and V; display data represented using HSL color model includes one hue component H, one saturation component S, and one luminance component L. The various types of display signals can be converted between each other by the signal converting module 402 using any known color model conversion algorithms as known in the art.

The signal converting module 402 may include a first signal converting unit configured to, for each pixel on the display 102, receive a first signal including a first set of components and convert the first set of components to a second set of components of the first signal. The first signal may be initially generated using RGB color model such that each of the first set of components represents the same attribute of a pixel, i.e., colors, has the same display bandwidth, and is equally important for apparent display resolution. The second set of components of the first signal on the other hand, include a first component representing a first attribute of the pixel and a second component representing a second attribute of the pixel. The first and second components represent different attributes of a pixel, such as luminance and chrominance components, each of which has a different display bandwidth and is not equally important for apparent display resolution.

The signal converting module 402 may also include a second signal converting unit configured to, for each pixel on the display 102, convert the second set of components, either in its native form or in a modified form by signal processing, back to the corresponding first set of components. That is, the first and second signal converting units perform inverse conversions between two types of display signals.

In this example, the signal converting module 402 includes an RGB-YUV converting unit 408 and a YUV-RGB converting unit 410. The RGB-YUV converting unit 408 is configured to receive the native display data 106 including R, G, and B components, and convert the R, G, and B components to Y, U, and V components. R, G, and B components are considered as representing the same attribute of a pixel, i.e., colors, while Y, U, and V components represent two different attributes of a pixel, i.e., luminance and chrominance. The YUV-RGB converting unit 410 is configured to convert the Y, U, and V components back to the R, G, and B components.

The signal processing module 404 may include one or more signal processing units, each of which is capable of applying one signal processing operation to at least one component of a display signal based on the corresponding attribute of a pixel represented by the component. The signal processing module 404 in this example is configured to, for each pixel on the display 102, modify the second set of components of the first signal to generate a second signal including a modified second set of components and convert the modified second set of components of the second signal to a modified first set of components of the second signal. The signal processing units may include, for example, a Fourier transform/inverse Fourier transform unit 412 and a low-pass filtering unit 414 as shown in FIG. 4. It is understood that any other signal processing units known in the art may be applied, such as a wavelet transform unit, a Laplace transforms unit, a high-pass filtering unit, a band-pass filtering unit, a band-stop pass filtering unit, to name a few. The operation(s) performed by the signal processing module 404 reduce a bandwidth of at least one of the components in the second set of components that has been converted by the signal converting module 402.

In this example, for each pixel, the converted Y, U, and V components are sent from the RGB-YUV converting unit 408 to the Fourier transform/inverse Fourier transform unit 412. Fourier transform is applied to each or some of the Y, U, and V components, followed by low-pass filtering performed by the low-pass filtering unit 414 in the frequency domain. The filtered Y, U, and V components are sent back to the Fourier transform/inverse Fourier transform unit 412 where the inverse Fourier transform is applied to generate modified Y, U, and V components. The modified Y, U, and V components are converted to modified R, G, and B components by the YUV-RGB converting unit 410 as mentioned above. It is noted that as the Y, U, and V components represent different attributes of a pixel with different display bandwidths, the manner in which the signal processing operation(s) are applied to each of the Y, U, and V components are also different. It is known that Y component is more important for apparent display resolution (higher bandwidth) than the U and V components. In one example, signal processing operation(s) are applied only to the U and V components by the signal processing module 404 to reduce their bandwidths while the Y component is intact. In another example, signal processing operation(s) are applied to each of the Y, U, and V components by the signal processing module 404 but at different degrees. For example, a higher cutoff frequency may be applied by the low-pass filtering unit 414 to the Y component compared with the U and V components so that more information in the Y component can be persevered.

The subpixel rendering module 406 is configured to generate a third signal based on the modified first set of components of the second signal. In this example, the subpixel rendering module 406 generates the control signals 108 for rendering each subpixel on the display 102 based on the second signal. As mentioned above, the display signals may be represented at the pixel level and thus, need to be converted to the control signals 108 for driving each of the subpixels by the subpixel rendering module 406. In the example shown in FIGS. 2 and 3 where each pixel is divided into two adjacent subpixels, for each pixel, the subpixel rendering module 406 renders each of the two subpixels based on a corresponding component in the modified first set of components of the second signal. For example, one pixel may be divided into R and B subpixels while the corresponding second display signal from the signal converting module 402 may include three modified components, R, G, and B. In this case, the R and B components are used for driving the corresponding R and B subpixels, respectively, while the G component in the display signal is disregarded by the subpixel rendering module 406 as there is no corresponding G subpixel.

Figure 5:
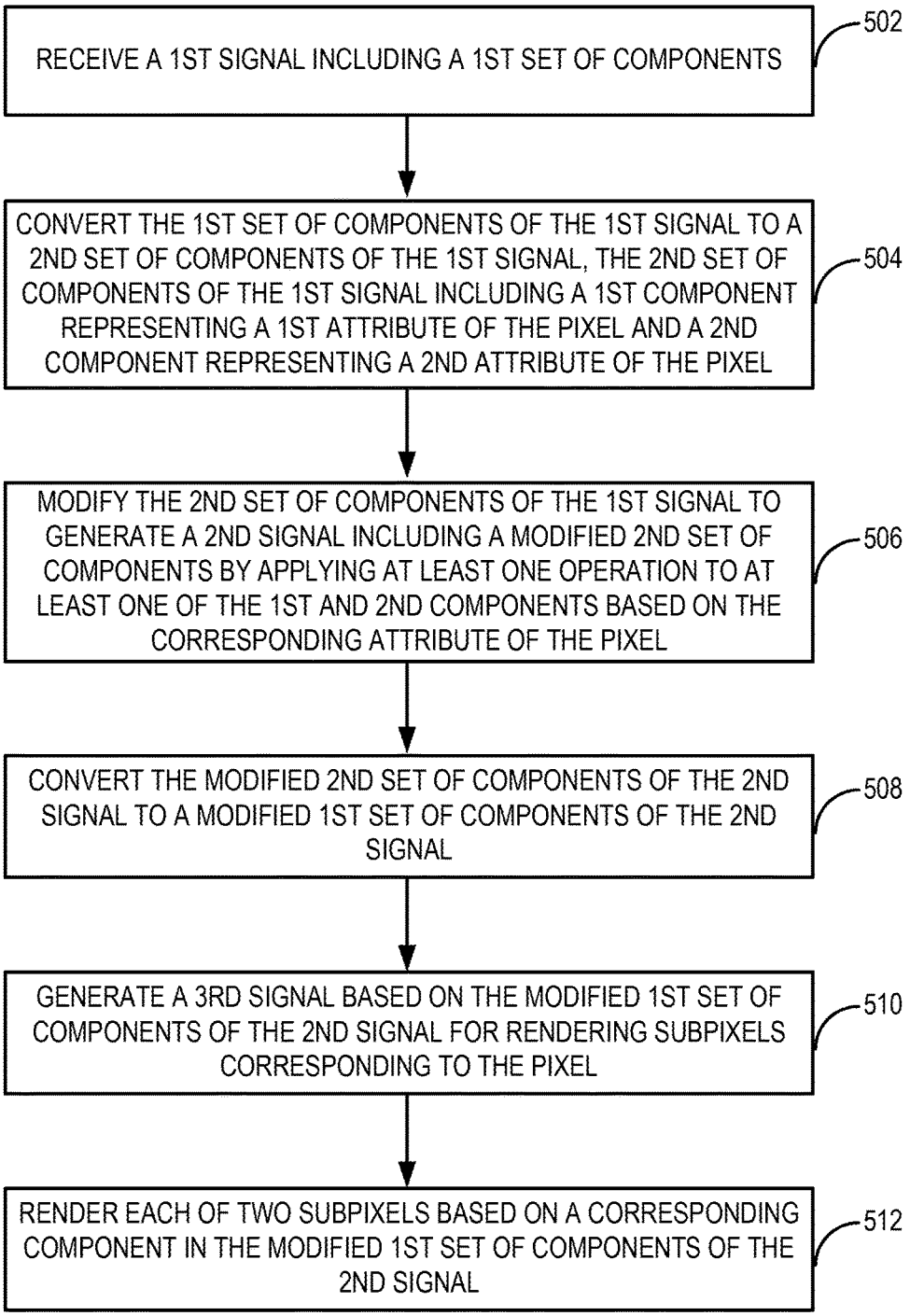
FIG. 5 is a flow chart illustrating a method for subpixels rendering.

FIG. 5 illustrates a method for subpixels rendering. It will be described with reference to FIG. 4. However, any suitable logic, module or unit may be employed. In operation, at block 502, for each of an array of pixels on a display, a first signal including a first set of components is received. Each component of the first set of components of the first signal may represent the same attribute of the pixel. For example, the first set of components of the first signal include RGB components. Moving to block 504, for each pixel, the first set of components of the first signal are converted to a second set of components of the first signal. The second set of components of the first signal include a first component representing a first attribute of the pixel and a second component representing a second attribute of the pixel. The first attribute of the pixel may include luminance, and the second attribute of the pixel may include chrominance. For example, the second set of components of the first signal include YUV components. As mentioned above, blocks 502 and 504 may be implemented by the signal converting module 402 of the control logic 104.

Proceeding to block 506, for each pixel, the second set of components of the first signal are modified to generate a second signal including a modified second set of components by applying at least one operation to at least one of the first and second components based on the corresponding attribute of the pixel. The at least one operation reduces bandwidth of the at least one of the first and second components and includes, for example, Fourier transform and filtering. In one example, the at least one operation is applied to only one of the first and second components determined based on the corresponding attribute of the pixel, e.g., U and V components corresponding to chrominance of the pixel. In another example, the at least one operation is applied to each of the first and second components in a manner determined based on the corresponding attribute of the pixel. For example, a cutoff frequency of low-pass filtering applied to the first and second components is determined based on the corresponding attribute of the pixel. As mentioned above, this may be implemented by the signal processing module 404 of the control logic 104.

Moving to block 508, for each pixel, the modified second set of components of the second signal are converted to a modified first set of components of the second signal. Each component of the modified first set of components of the second signal may represent the same attribute of the pixel. For example, the modified first set of components of the second signal include RGB components. As mentioned above, this may be implemented by the signal converting module 402 of the control logic 104.

At block 510, for each pixel, a third signal is generated based on the modified first set of components of the second signal for rendering subpixels corresponding to the pixel. Each pixel may be divided into two subpixels rendered by the third signal, and for each pixel, at block 512, the two subpixels are rendered based on a corresponding component in the modified first set of components of the second signal. As mentioned above, blocks 510 and 512 may be implemented by the subpixel rendering module 406 of the control logic 104.

Figure 6:
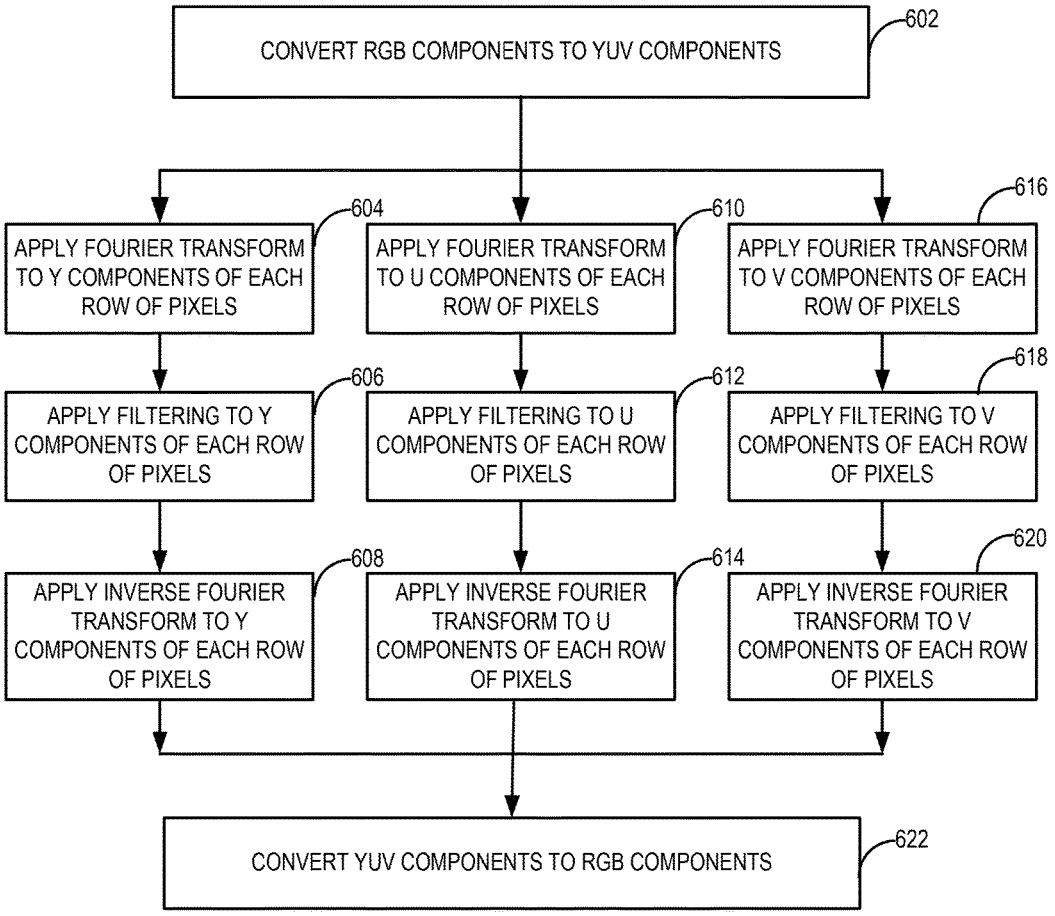
FIG. 6 is a flow chart illustrating one example of the method for subpixel rendering shown in FIG. 5 in accordance with one embodiment set forth in the disclosure.
Figure 7:
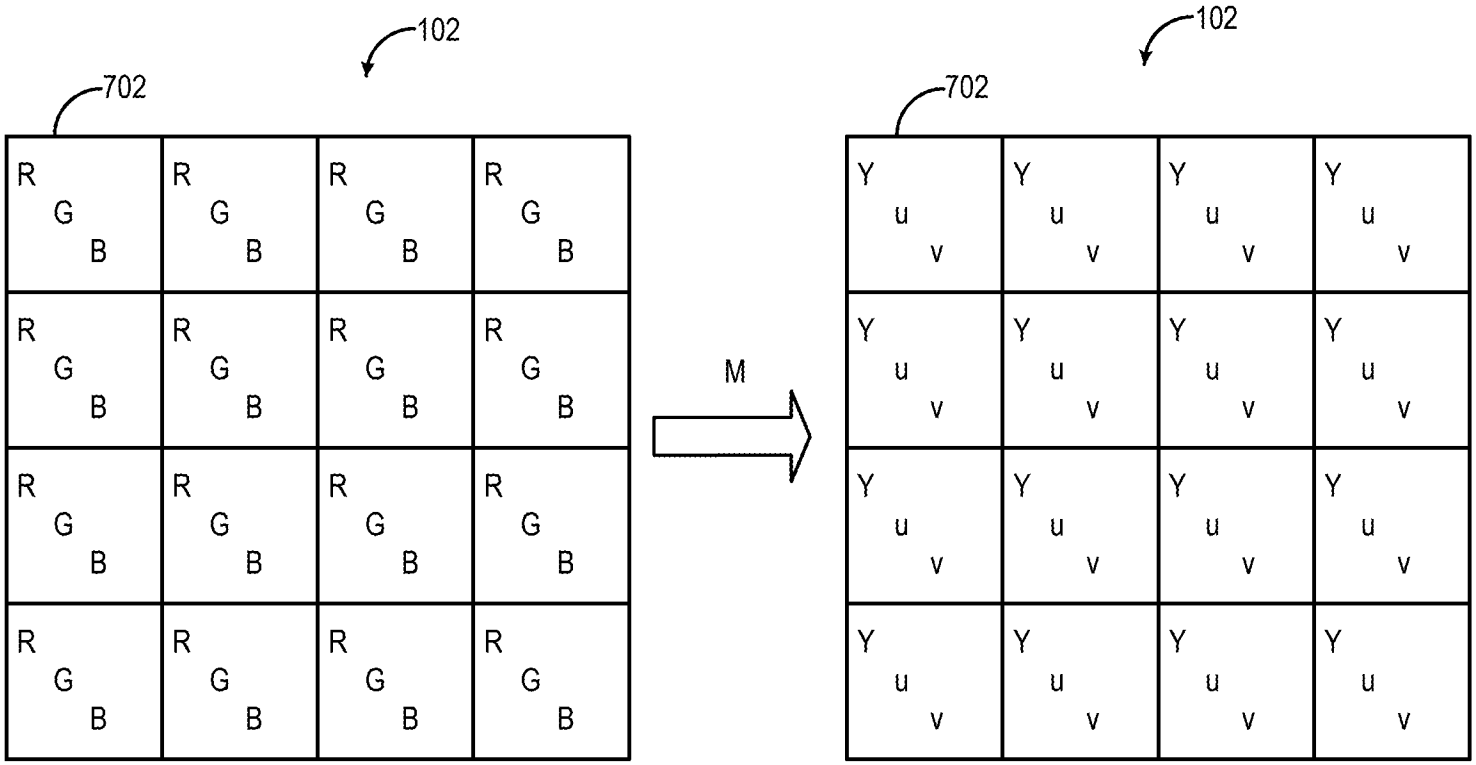
FIG. 7 is a depiction of converting a first set of RGB components in display data to a second set of YUV components in the display data for each pixel in accordance with one embodiment set forth in the disclosure.

FIG. 6 illustrates one example of the method for subpixel rendering shown in FIG. 5 in accordance with one embodiment set forth in the disclosure. It will be described with reference to FIG. 4. However, any suitable logic, module or unit may be employed. In operation, at block 602, for each pixel of the display 102, R, G, and B components in a first display signal is converted to Y, U, and V components in the first display signal. Now referring to FIG. 7, each pixel 702 of the display 102 corresponds to a first display signal including R, G, and B components. The conversion from R, G, and B components to Y, U, and V components for each pixel 702 may be done through a matrix transformation. For example, a transformation matrix M may be applied for the conversion as shown below in Equation (1):

$$\begin{bmatrix} Y \\ U \\ V \end{bmatrix} = \begin{bmatrix} 0.299 & 0.587 & 0.114 \\ -0.14713 & -0.28886 & 0.436 \\ 0.615 & -0.51499 & -0.10001 \end{bmatrix} \begin{bmatrix} R \\ G \\ B \end{bmatrix} \quad (1)$$

As mentioned above, this may be implemented by the RGB-YUV converting unit 408 of the control logic 104.

Figure 8:
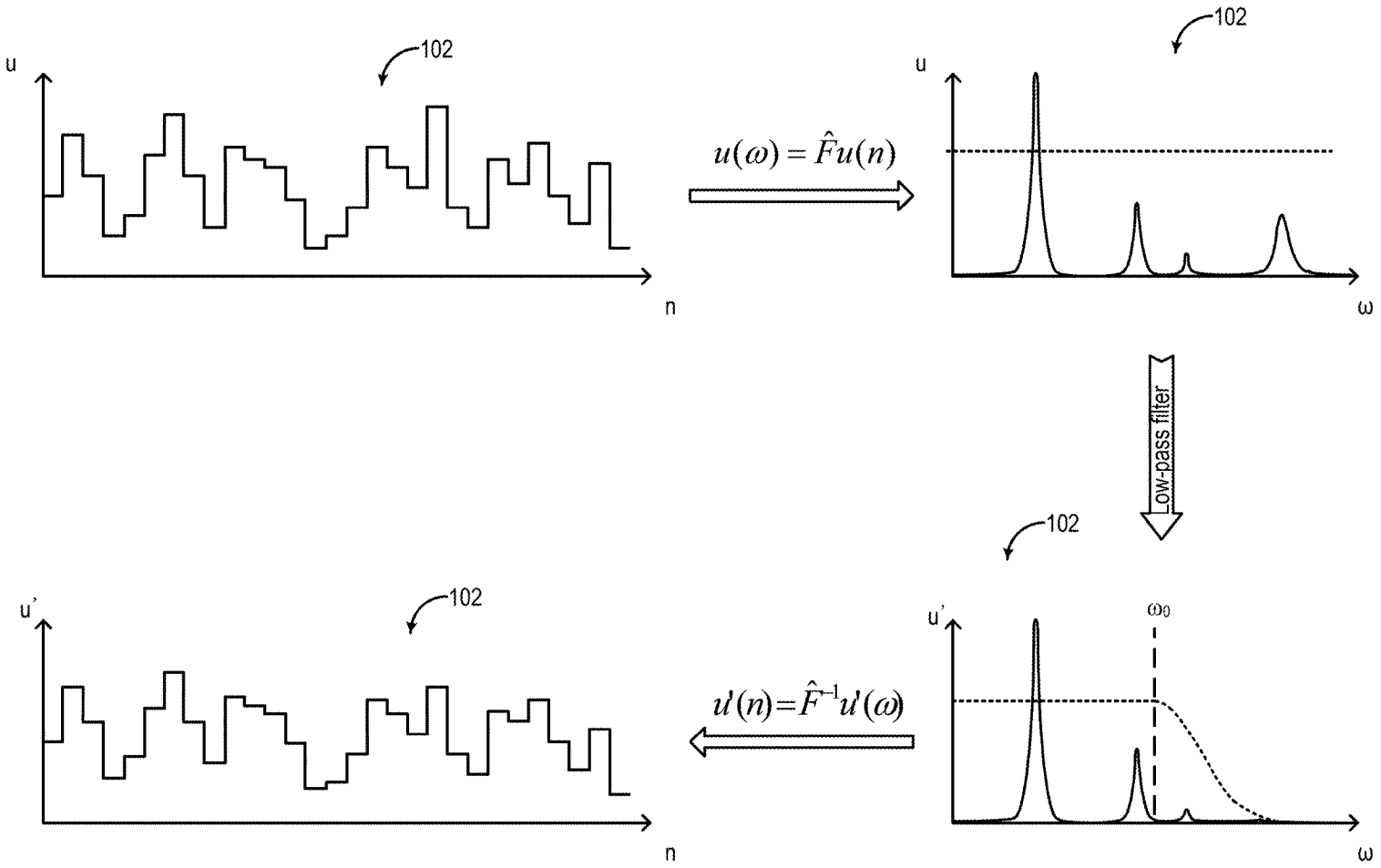
FIG. 8 is a depiction of applying Fourier transform and filtering to the U component in accordance with one embodiment set forth in the disclosure.

Referring back to FIG. 6, in this example, for each of the Y, U, and V components, a series of signal processing operations are applied to each row of pixels in order to reduce the display bandwidth. For U components of each row of pixels, Fourier transform is applied at block 604. As shown in FIG. 8, Fourier transform F is applied to the U components u of a row of pixel n to transform the native U components of the row of pixels u(n) 802 to U components in the frequency domain u(ω) 804 as represented by Equation (2):

$$u(\omega)=Fu(n) \quad (2)$$

It is noted that in this example, as U components of each pixel in a row are discrete signals, discrete Fourier transform (DFT) is applied. Referring back to FIG. 6, at block 606, filtering is then applied to the U components (u) in the frequency domain for each row of pixels. As shown in FIG. 8, low-pass filtering is applied to the U components in the frequency domain u(ω) 804 to obtain filtered U components in the frequency domain u'(ω) 806. High frequency signals (above the cutoff frequency $\omega_0$) are filtered out to reduce bandwidth. The cutoff frequency $\omega_0$ may be a preset parameter or a configurable parameter. In one example, the cutoff frequency is set such that U components of half of the pixels in a row are filtered out. For example, for a display having 720 pixels in each row, the cutoff frequency may be specifically set such that the U components of the 361th to 720th pixels in each row are filtered out. Referring back to FIG. 6, at block 608, inverse Fourier transform $F^{-1}$ is applied to the filtered U components in the frequency domain u'(ω) 806 for each row of pixels to obtain modified U components of the row of pixels u'(n) 808 as represented by Equation (3):

$$u'(n)=F^{-1}u'(\omega) \quad (3)$$

It is noted that in this example, as the modified U components of each pixel in a row are discrete signals, discrete inverse Fourier transform (DIFT) is applied. As mentioned above, blocks 604, 606, and 608 may be implemented by the Fourier transform/inverse Fourier transform unit 412 and low-pass filtering unit 414 of the control logic 104.

Referring back to FIG. 6, similarly, for V components of each row of pixels, Fourier transform, filtering, and inverse Fourier transforms are applied at blocks 610, 612, and 614, respectively. In this example, as both U and V components are chrominance components, the same cutoff frequency $\omega_0$ is applied at blocks 608 and 612. It is understood that, in other examples, different cutoff frequencies may be applied to low-pass filtering for U and V components.

For Y components, Fourier transform, filtering, and inverse Fourier transforms may be also applied to each row of pixels at blocks 616, 618, and 620, respectively. As the human vision system is more sensitive to brightness than to color, the luminance component (Y) is considered to be more important than the chrominance components (U and V). In this example, a higher cutoff frequency is applied at block 618 for low-pass filtering of the Y component compared to the cutoff frequencies that are applied at blocks 606 and 612 for low-pass filtering of the U and V components. Thus, more information in the luminance component is preserved than that in the chrominance components. In another example, blocks 616, 618 and 620 may be omitted such that the Y components in the native display data remain intact.

Figure 9:
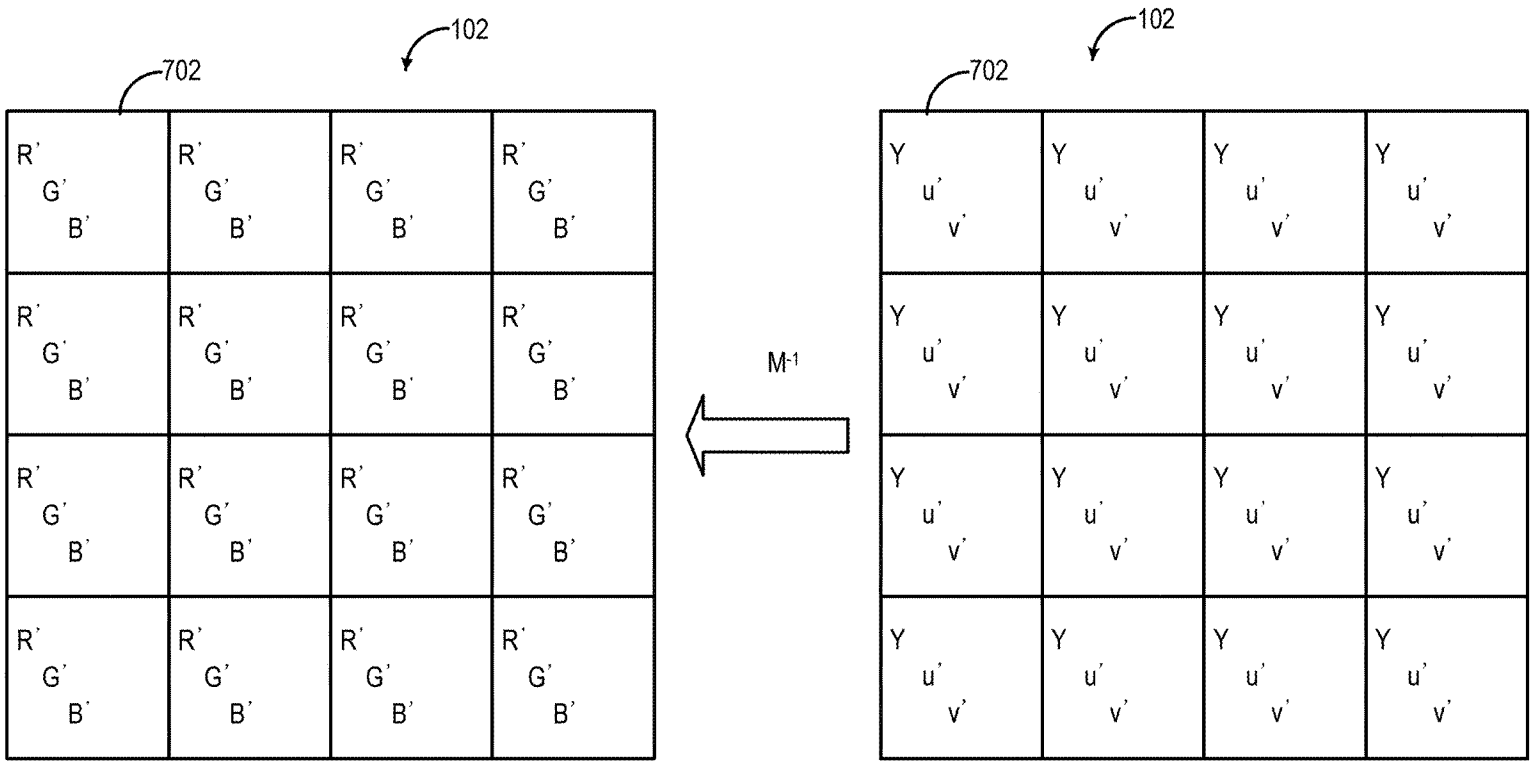
FIG. 9 is a depiction of converting a modified second set of YUV components to a modified first set of RGB components for each pixel in accordance with one embodiment set forth in the disclosure.

Proceeding to block 622, for each pixel of the display 102, the modified Y, U, and V components in a second display signal are converted to modified R, G, and B components in the second display signal. Now referring to FIG. 9, each pixel 702 of the display 102 corresponds to a second display data including the modified U and V components (u' and v'). As mentioned above, the Y component may be the native Y component (Y) as shown in FIG. 9 or the modified Y component (Y'). The conversion from Y, U, and V components to R, G, and B components for each pixel 702 may be done through a matrix transformation. For example, a transformation matrix $M^{-1}$ may be applied for the conversion as shown below in Equation (4):

$$\begin{bmatrix} R \\ G \\ B \end{bmatrix} = \begin{bmatrix} 1 & 0 & 1.13983 \\ 1 & -0.39465 & -0.58060 \\ 1 & 2.03211 & 0 \end{bmatrix} \begin{bmatrix} Y \\ U \\ V \end{bmatrix} \quad (4)$$

As mentioned above, this may be implemented by the YUV-RGB converting unit 410 of the control logic 104. It is also understood that the processing blocks for each component may be implemented as a processing pipeline, and multiple processing pipelines for each component may be executed in parallel.

Figure 10:
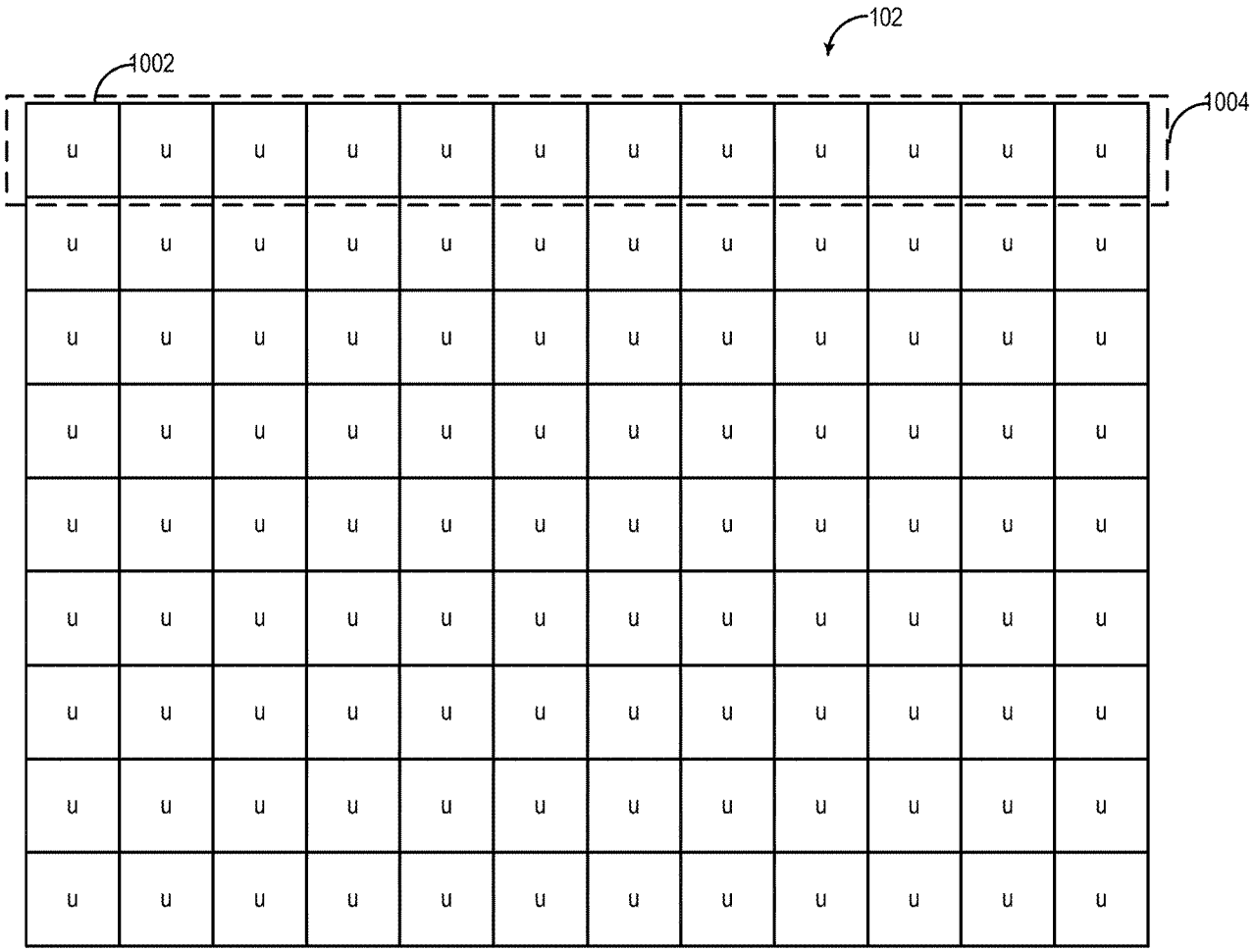
FIG. 10 is a depiction of applying signal processing operation(s) to a plurality of adjacent pixels in the same row of the pixel in accordance with one embodiment set forth in the disclosure.

FIG. 10 is a depiction of applying signal processing operation(s) to a plurality of adjacent pixels in the same row of the pixel in accordance with one embodiment set forth in the disclosure. In this embodiment, for each pixel 1002 of the display 102, the signal processing operation(s) are applied to the adjacent pixels in the same row 1004. In the example disclosed in FIGS. 6 and 8, Fourier transform and filtering are applied to the entire row of pixels. In other examples, signal processing operation(s) may be applied to not all of the pixels in the same row, rather, just some of them, e.g., ¼ of the pixels in the same row or half of the pixels in the same row. Nevertheless, in this embodiment, the signal processing operation(s) are applied in a one-dimensional (1D) space.

Figure 12:
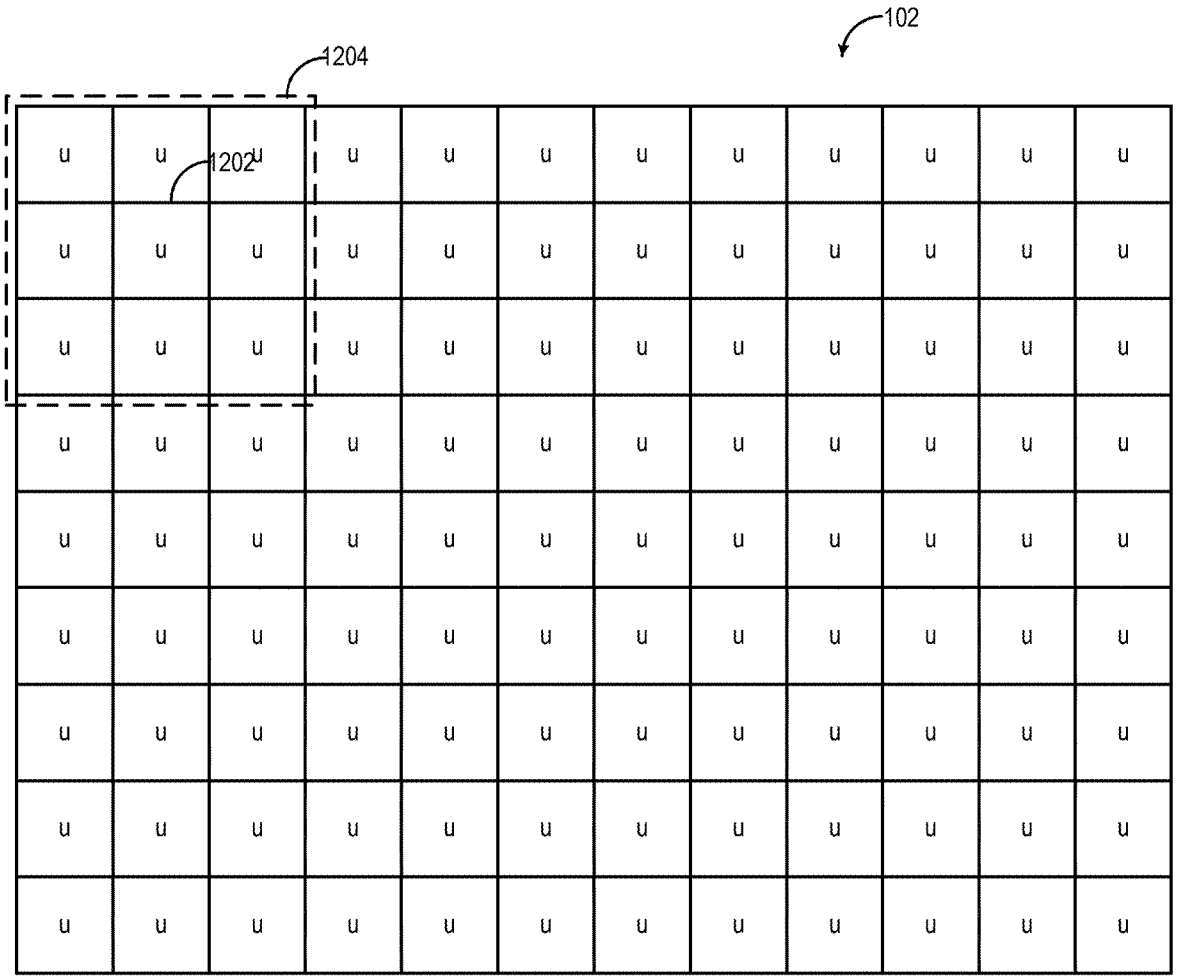
FIG. 12 is a depiction of applying signal processing operation(s) to a plurality of adjacent pixels in adjacent rows and columns of pixels in accordance with one embodiment set forth in the disclosure.

FIG. 12 is a depiction of applying signal processing operation(s) to a plurality of adjacent pixels in adjacent rows and columns of pixels in accordance with one embodiment set forth in the disclosure. Different from FIG. 10, the signal processing operation(s) are applied in a two-dimensional (2D) space in this embodiment. For each pixel, signal processing operation(s) are applied to a plurality of adjacent pixels in at least two adjacent rows and two adjacent columns. In one example as shown in FIG. 12, for a pixel 1202, signal processing operation(s) are applied to nine pixels in adjacent rows and columns. That is, signal processing operation(s) are applied to a 2D pixel group 1204 to which the pixel 1202 belongs. It is understood that the size of the 2D pixel group 1204 is not limited and may be for example, a 2 by 2 pixel group, a 3 by 3 pixel group as shown in FIG. 12, or any m by n pixel group (m and n may be the same or different).

Figure 11:
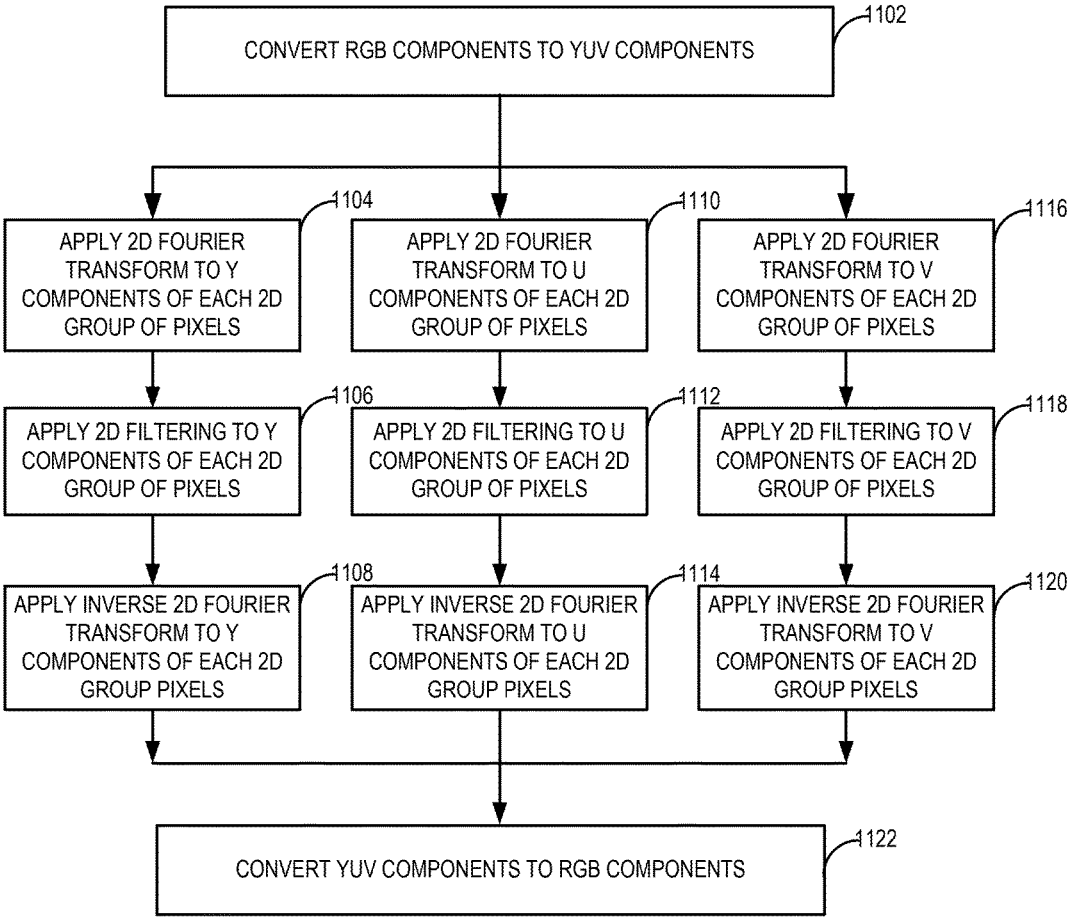
FIG. 11 is a flow chart illustrating another example of the method for subpixel rendering shown in FIG. 5 in accordance with one embodiment set forth in the disclosure.

FIG. 11 illustrates another example of the method for subpixel rendering shown in FIG. 5 in accordance with one embodiment set forth in the disclosure. The method disclosed in FIG. 11 is similar to that in FIG. 6 except that 2D signal processing operations, e.g., 2D Fourier transform, 2D filtering, and inverse 2D Fourier transform are applied to each of the Y, U, and V components of each 2D pixel group as described in FIG. 11. At blocks 1104, 1106, and 1108, 2D Fourier transform, 2D filtering, and inverse 2D Fourier transform are applied to the U components of each 2D pixel group, respectively. At blocks 1110, 1112, and 1114, 2D Fourier transform, 2D filtering, and inverse 2D Fourier transform are applied to the V components of each 2D pixel group, respectively. Optionally, at blocks 1116, 1118, and 1120, 2D Fourier transform, 2D filtering, and inverse 2D Fourier transform are applied to the Y components of each 2D pixel group, respectively. It is also understood that the processing blocks for each component may be implemented as a processing pipeline, and multiple processing pipelines for each component may be executed in parallel.

Figure 13:
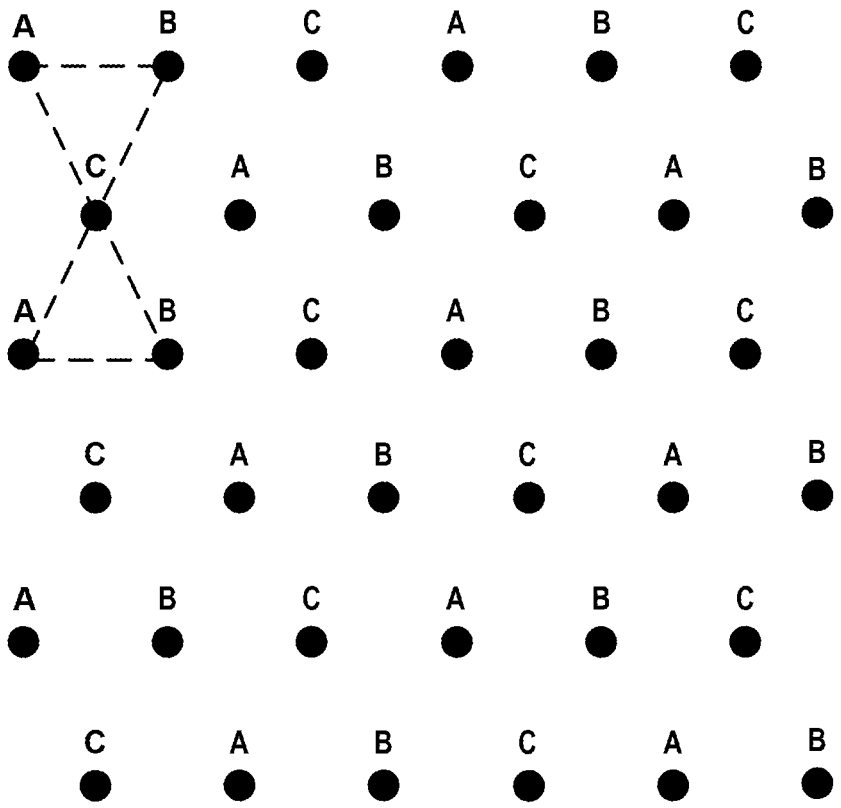
FIG. 13 is a depiction of a subpixel arrangement of a display in accordance with one embodiment set forth in the disclosure.

FIG. 13 depicts a subpixel arrangement of the display 1300 in accordance with one embodiment set forth in the disclosure. The display 1300 includes an array of subpixels (represented by each dot in FIG. 13) arranged in a regular pattern. A, B, and C in FIG. 13 denote three different types of subpixels, such as but not limited to, red, green, blue, yellow, cyan, magenta, or white subpixel. FIG. 13 may be, for example, a top view of the display 102 and depicts one example of the subpixel arrangements of the display 1300. The shape of each subpixel is not limited and may include, for example, rectangular, square, circle, triangular, etc. The array of subpixels may have the same shape or different shapes in various examples. The size of each subpixel may be the same or different in various examples.

As shown in FIG. 13, the subpixels in each of the odd rows, e.g., 1st, 3rd, and 5th rows, are repeated in the sequence of A-B-C, and the subpixels in each of the even rows, e.g., 2nd, 4th, and 6th rows, are repeated in the sequence of C-A-B. In other words, a subpixel group A-B-C is repeated in each odd row while a subpixel group C-A-B is repeated in each even row. It is understood that, the subpixel group A-B-C may be repeated in each even row while the subpixel group C-A-B may be repeated in each odd row. That is, two subpixel repeating groups: A-B-C and C-A-B are alternatively applied to two adjacent rows of subpixels.

As shown in FIG. 13, subpixels in two adjacent rows are not aligned with each other in the vertical direction, but instead, are shifted for a distance in the horizontal direction. For example, the left-most subpixel C in the 2nd row in FIG. 13 is not aligned with the left-most subpixel A in the 1st row in the vertical direction, but is shifted by half of the distance between two adjacent subpixels in the same row in the horizontal direction. That is, two adjacent rows are staggered with each other by half of the distance between two adjacent subpixels in the same row. It is understood that, in other examples, two adjacent rows may be staggered with each other by any arbitrary distance, e.g., ¼ or ⅓ of the distance between two adjacent subpixels in the same row.

As a result of the subpixel arrangement described above with respect to FIG. 13, each subpixel and the two closest subpixels thereof in one of the adjacent rows are always different from each other. For example, the left-most subpixel in the 2nd row in FIG. 13 is C, while the two closest subpixels thereof in the 1st or 3rd row are A and B. Accordingly, a uniform color distribution is achieved because of the subpixel arrangement described above with respect to FIG. 13. In one example, the number of each color of subpixels (A, B and C) is the same, and the distance between two adjacent subpixels with different colors (relative distance of A, B and C) is substantially the same.

Figure 14:
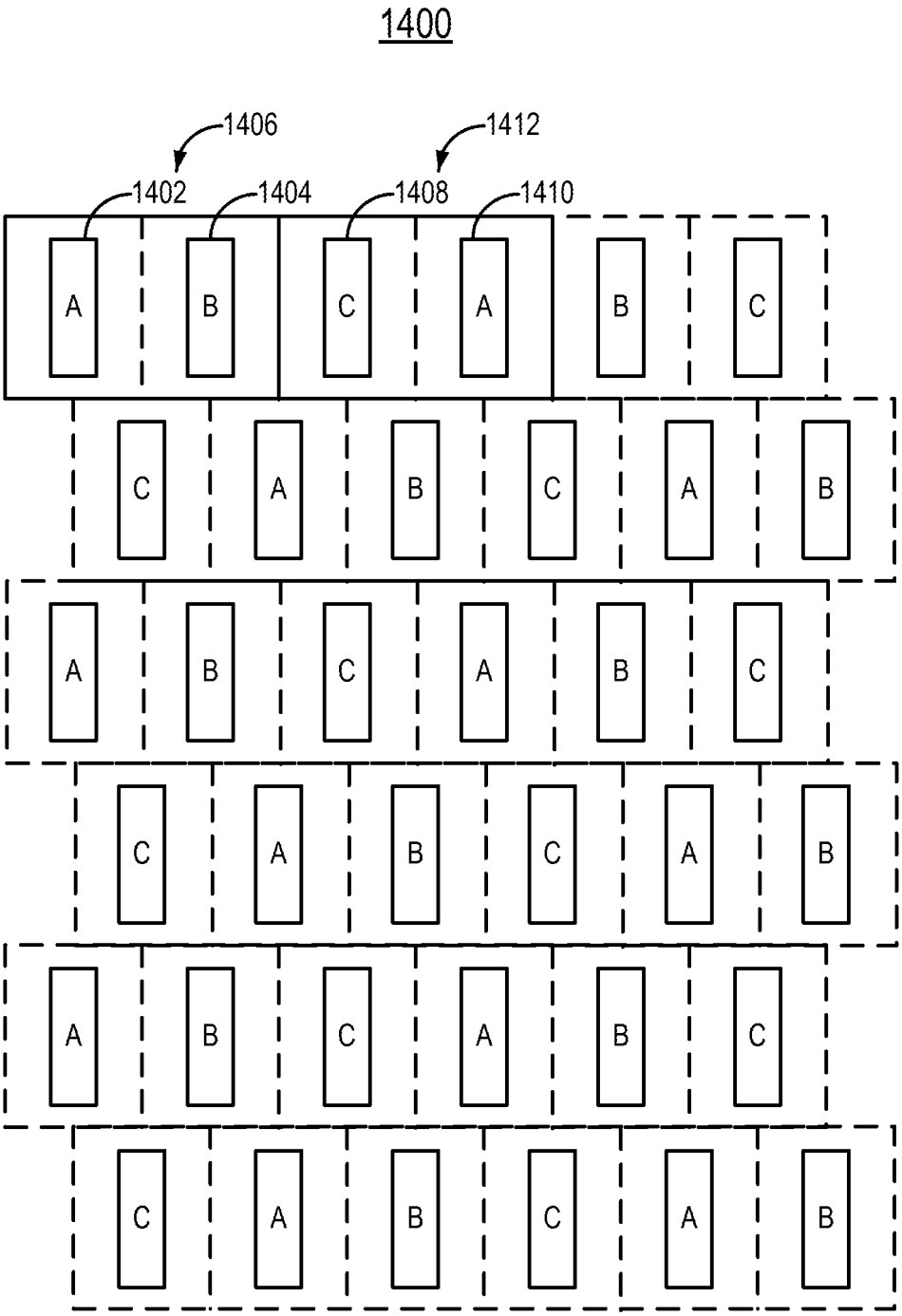
FIG. 14 is a depiction of a subpixel arrangement of a display in accordance with one embodiment set forth in the disclosure.

FIG. 14 depicts a subpixel arrangement of a display 1400 in accordance with one embodiment set forth in the disclosure. The display 1400 includes an array of subpixels arranged in a regular pattern. A, B, and C in FIG. 14 denote three different types of subpixels, such as but not limited to, red, green, blue, yellow, cyan, magenta, or white subpixel. FIG. 14 may be, for example, a top view of the display 102 and depicts one example of the subpixel arrangements of the display 1400. In this example, each of the subpixels has substantially the same size and a rectangular shape. Two adjacent subpixels in the same row correspond to a pixel of the display 1400 in this example. For example, subpixel A 1402 and subpixel B 1404 correspond to one pixel 1406, subpixel C 1408 and subpixel B 1410 correspond to another pixel 1412, and so on. Similarly, two subpixel repeating groups: A-B-C and C-A-B are alternatively applied to adjacent two rows of subpixels in FIG. 14. Two adjacent rows are staggered with each other by ¼ of the width of a pixel in FIG. 14. In this example, the number of each color of subpixels (A, B and C) is the same, and the distance between two adjacent subpixels with different colors (relative distance of A, B and C) is substantially the same.

In this embodiment, the subpixels are rendered by the control signals 108, i.e., the third signals in FIGS. 4 and 5, generated from the control logic 104. For each pixel, the subpixel rendering module 406 renders each of the two subpixels based on a corresponding component in the modified first set of components of the second signal. For example, one pixel may be divided into R and B subpixels while the corresponding second display signal from the signal converting module 402 may include three modified first components, R, G, and B. In this case, the R and B components are used for driving the corresponding R and B subpixels, respectively, while the G component in the display signal is disregarded by the subpixel rendering module 406 as there is no corresponding G subpixel.

Figure 15:
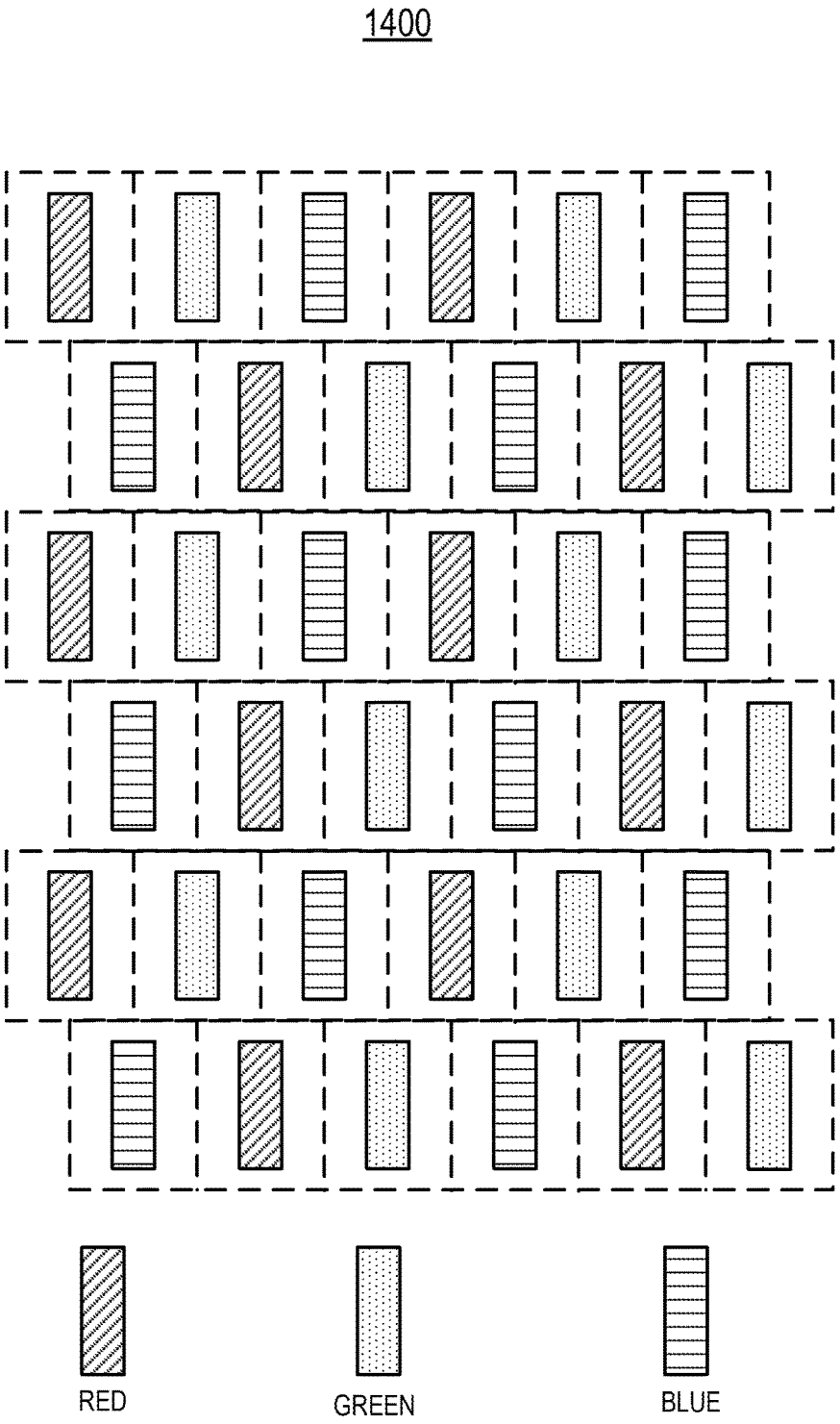
FIG. 15 is a depiction of a red, green, and blue subpixel arrangement of a display in accordance with one embodiment set forth in the disclosure.

FIG. 15 depicts one example of the subpixel arrangement of the display 1400 in FIG. 14 in accordance with one embodiment set forth in the disclosure. In this example, the display 1400 is an OLED display, and each type of subpixel may include an OLED emitting different color of light. The subpixel A is a red OLED, the subpixel B is a green OLED, and the subpixel C is a blue OLED. The arrangement of the red, green, and blue OLEDs in FIG. 15 is the same as that in FIG. 14. As a result, a uniform distribution of red, green, and blue colors (uniform resolution of different colors) for OLED display is achieved. In this example, the number of each color of OLEDs (red, green and blue) is the same, and the distance between two adjacent OLEDs with different colors (relative distance of red, green and blue) is substantially the same.

Aspects of the method for subpixel rendering, as outlined above, may be embodied in programming. Program aspects of the technology may be thought of as "products" or "articles of manufacture" typically in the form of executable code and/or associated data that is carried on or embodied in a type of machine readable medium. Tangible non-transitory "storage" type media include any or all of the memory or other storage for the computers, processors or the like, or associated modules thereof, such as various semiconductor memories, tape drives, disk drives and the like, which may provide storage at any time for the software programming.

All or portions of the software may at times be communicated through a network such as the Internet or various other telecommunication networks. Such communications, for example, may enable loading of the software from one computer or processor into another, for example, from a management server or host computer of the search engine operator or other explanation generation service provider into the hardware platform(s) of a computing environment or other system implementing a computing environment or similar functionalities in connection with generating explanations based on user inquiries. Thus, another type of media that may bear the software elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, unless restricted to tangible "storage" media, terms such as computer or machine "readable medium" refer to any medium that participates in providing instructions to a processor for execution.

Hence, a machine readable medium may take many forms, including but not limited to, a tangible storage medium, a carrier wave medium or physical transmission medium. Non-volatile storage media include, for example, optical or magnetic disks, such as any of the storage devices in any computer(s) or the like, which may be used to implement the system or any of its components as shown in the drawings. Volatile storage media include dynamic memory, such as a main memory of such a computer platform. Tangible transmission media include coaxial cables; copper wire and fiber optics, including the wires that form a bus within a computer system. Carrier-wave transmission media can take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards paper tape, any other physical storage medium with patterns of holes, a RAM, a PROM and EPROM, a FLASH-EPROM, any other memory chip or cartridge, a carrier wave transporting data or instructions, cables or links transporting such a carrier wave, or any other medium from which a computer can read programming code and/or data. Many of these forms of computer readable media may be involved in carrying one or more sequences of one or more instructions to a processor for execution.

The above detailed description of the disclosure and the examples described therein have been presented for the purposes of illustration and description only and not by limitation. It is therefore contemplated that the present disclosure cover any and all modifications, variations or equivalents that fall within the spirit and scope of the basic underlying principles disclosed above and claimed herein.

What is claimed is:

1. An apparatus comprising:

a display panel having an array of subpixels arranged in a repeating pattern thereon, wherein a pixel consists of two adjacent subpixels in a same row of the array of subpixels;

a first subpixel repeating group and a second subpixel repeating group are alternatively applied to two adjacent rows of the array of subpixels;

the first subpixel repeating group is represented by A-B-C, and the second subpixel repeating group is represented by C-A-B, where A denotes a subpixel in a first color, B denotes a subpixel in a second color, and C denotes a subpixel in a third color;

two adjacent rows of the array of subpixels are staggered with each other; and the display panel has a first type of pixels each consisting of a subpixel A and a subpixel B, a second type of pixels each consisting of a subpixel A and a subpixel C, and a third type of pixels each consisting of a subpixel B and a subpixel C.

2. The apparatus of claim 1, further comprising:

control logic operatively connected to the display panel and configured to render the array of subpixels, the control logic comprising:

a first signal converting unit configured to, for each pixel, receive a first signal including a first set of components, and convert the first set of components of the first signal to a second set of components of the first signal, wherein the second set of components of the first signal include a first component representing a first attribute of the pixel and a second component representing a second attribute of the pixel;

a signal processing module configured to, for each pixel, modify the second set of components of the first signal to generate a second signal including a modified second set of components by applying at least one operation to at least one of the first and second components based on the corresponding attribute of the pixel;

a second signal converting unit configured to, for each pixel, convert the modified second set of components of the second signal to a modified first set of components of the second signal; and a subpixel rendering module configured to, for each pixel, generate a third signal based on the modified first set of components of the second signal for rendering the two subpixels consisted of the pixel.

3. The apparatus of claim 1, wherein A denotes a red subpixel, B denotes a green subpixel, and C denotes a blue subpixel.

4. The apparatus of claim 1, wherein two adjacent rows are staggered with each other by ¼ of the width of the pixel.

5. The apparatus of claim 1, wherein each subpixel in the array has a substantially rectangular shape.

6. The apparatus of claim 1, wherein the numbers of A, B, and C subpixels in the array are the same.

7. The apparatus of claim 1, wherein each subpixel in the array is an organic light emitting diode (OLED).

8. The apparatus of claim 1, wherein distances between two adjacent subpixels in different colors are substantially the same.

9. The apparatus of claim 1, wherein the number of each of the first, second, and third types of pixels is ⅓ of the number of pixels on the display panel.

10. The apparatus of claim 2, wherein each component of the first set of components of the first signal and each component of the modified first set of components of the second signal represents the same attribute of the pixel.

11. The apparatus of claim 2, wherein the first attribute of the pixel includes luminance and the second attribute of the pixel includes chrominance.

12. The apparatus of claim 2, wherein each of the first set of components of the first signal and the modified first set of components of the second signal include RGB components.

13. The apparatus of claim 2, wherein each of the second set of components of the first signal and the modified second set of components of the second signal include YUV components.

14. The apparatus of claim 2, wherein the subpixel rendering module is further configured to, for each pixel, render each of the two subpixels based on a corresponding component in the modified first set of components of the second signal.

15. The apparatus of claim 2, wherein the at least one operation is applied to only one of the first and second components determined based on the corresponding attribute of the pixel.

16. The apparatus of claim 2, wherein the at least one operation is applied to each of the first and second components in a manner determined based on the corresponding attribute of the pixel.

17. The apparatus of claim 2, wherein the at least one operation reduces a bandwidth of the at least one of the first and second components.

18. The apparatus of claim 2, wherein the at least one operation includes Fourier transform and filtering.

19. The apparatus of claim 18, wherein a cutoff frequency of filtering applied to the first and second components is determined based on the corresponding attribute of the pixel.

20. The apparatus of claim 2, wherein, for each pixel, the at least one operation is applied to a plurality of adjacent pixels in the same row of the pixel.

21. The apparatus of claim 2, wherein, for each pixel, the at least one operation is applied to a plurality of adjacent pixels in at least two adjacent rows and two adjacent columns.

22. The apparatus of claim 21, wherein the at least one operation includes two-dimensional (2D) Fourier transform and 2D filtering.

* * * * *